US006007187A

United States Patent [19]

Kashino et al.

[11] Patent Number: 6,007,187

[45] **Date of Patent: *Dec. 28, 1999**

[54] LIQUID EJECTING HEAD, LIQUID EJECTING DEVICE AND LIQUID EJECTING METHOD

[75] Inventors: Toshio Kashino, Chigasaki; Makiko Kimura; Takeshi Okazaki, both of Sagamihara; Aya Yoshihira; Kiyomitsu Kudo, both of Yokohama; Yoshie Nakata, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,334

[22] Filed: Apr. 26, 1996

[30] Foreign Application Priority Data

Apr. 26, 1995 [JP] Japan ..... 7-102461
Apr. 26, 1995 [JP] Japan ..... 7-127317

[51] Int. Cl.[6] ..... B41J 2/05

[52] U.S. Cl. ..... 347/65; 347/94

[58] Field of Search ..... 347/65, 63, 94, 347/44

[56] References Cited

U.S. PATENT DOCUMENTS

| | | | |
|---|---|---|---|
| 4,480,259 | 10/1984 | Kruger et al. . | |
| 4,496,960 | 1/1985 | Fischbeck . | |
| 4,723,129 | 2/1988 | Endo et al. | 347/56 |
| 4,922,269 | 5/1990 | Ikeda | 347/58 X |
| 4,994,825 | 2/1991 | Saito et al. . | |
| 5,095,321 | 3/1992 | Saito et al. . | |
| 5,208,604 | 5/1993 | Watanabe et al. . | |
| 5,274,400 | 12/1993 | Johnson et al. | 347/43 |
| 5,278,585 | 1/1994 | Karz et al. | 347/65 |
| 5,389,957 | 2/1995 | Kimura et al. . | |
| 5,581,287 | 12/1996 | Baezner | 347/85 |

FOREIGN PATENT DOCUMENTS

| | | | |
|---|---|---|---|
| 0443798 | 8/1991 | European Pat. Off. | B41J 2/14 |
| 4496533 | 7/1992 | European Pat. Off. | B41J 2/055 |
| 0568247 | 11/1993 | European Pat. Off. | B41J 2/04 |
| 0436047 | 7/1991 | Germany | B41J 2/055 |
| 55-81172 | 6/1980 | Japan | B41J 3/04 |
| 61-69467 | 4/1986 | Japan | B41J 3/04 |
| 61-110557 | 5/1986 | Japan | B41J 3/04 |
| 62-156969 | 7/1987 | Japan | B41J 3/04 |
| 63-197652 | 8/1988 | Japan | B41J 3/04 |
| 63-199972 | 8/1988 | Japan | B41J 3/04 |
| 3-81155 | 4/1991 | Japan | B41J 2/05 |
| 3-110170 | 5/1991 | Japan | B41J 2/05 |
| 4-185447 | 7/1992 | Japan | B41J 2/05 |
| 5-124189 | 5/1993 | Japan | B41J 2/05 |
| 6-87214 | 3/1994 | Japan | B41J 2/05 |

*Primary Examiner*—Joseph Hartary
*Attorney, Agent, or Firm*—Fitzpatrick, Cella, Harper & Scinto

[57] ABSTRACT

A liquid ejecting method includes providing a substrate having a heat generating surface for generating heat for generating a bubble in liquid; providing a movable member having a free end; providing an ejection outlet for ejecting the liquid using the generation of the bubble, the ejection outlet being opposed to the substrate with the movable member interposed therebetween; disposing the free end of the movable member at a downstream side with respect to a direction of flow of the liquid to the ejection outlet; and wherein the bubble displaces the free end of the movable member, and grows toward the ejection outlet to eject the liquid.

54 Claims, 24 Drawing Sheets

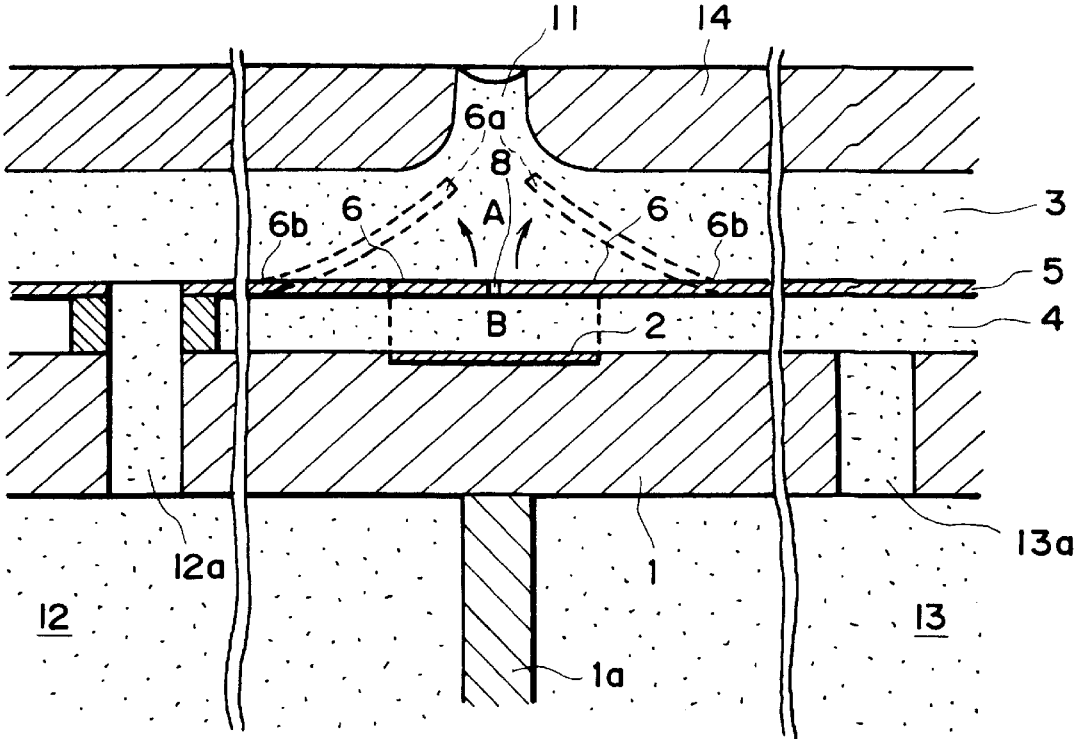
FIG. 12
FIG. 13A
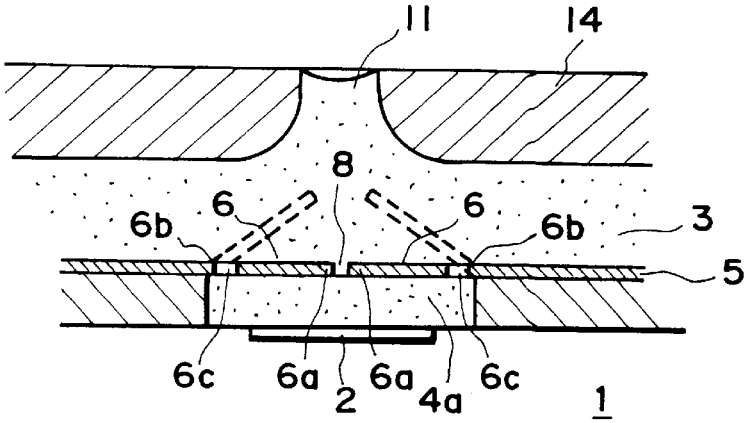
FIG. 13B
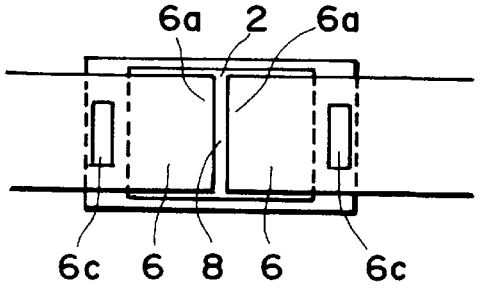

LIQUID EJECTING HEAD, LIQUID EJECTING DEVICE AND LIQUID EJECTING METHOD

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 propose flow passage structures as disclosed in FIG. 1, (a) and (b), for example.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When th valve is generated in the path 3, the suppression of the back wave is not practically significant. The back wave is not directly contributable to the ejection of the liquid. Upon the back wave occurs in the path, the pressure for directly ejecting the liquid already makes the liquid ejectable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink if this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is progated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the same effect is provided by the provision between the ejection liquid and the bubble generation liquid.

SUMMARY OF THE INVENTION

Accordingly, it is a principal object of the present invention to provide a liquid ejection principle with which the generated bubble is controlled in a novel manner.

It is another object of the present invention to provide a liquid ejecting method, liquid ejecting head and so on wherein heat accumulation in the liquid on the heat generating element is significantly reduced, and the residual bubble on the heat generating element is reduced, while improving the ejection and the ejection pressure.

It is a further object of the present invention to provide a liquid ejecting head and so on wherein inertia force in a direction against liquid supply direction due to back wave is suppressed, and simultaneously, a degree of retraction of a meniscus is reduction by a valve function of a movable member by which the refilling frequency is increased, thus permitting high speed printing.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

It is a further object of the present invention to provide a manufacturing method for a liquid ejecting head with which such a liquid ejecting head is easily manufactured.

It is a further object of the present invention to provide a liquid ejecting head, a printing apparatus and so on which can be easily manufactured because a liquid introduction path for supplying a plurality of liquids are constituted with a small number of parts it is an additional object to provide a downsized liquid ejecting head and device.

It is a further object of the present invention to provide a good print of an image using an above-described ejection method.

It is a further object of the present invention to provide a head kit for permitting easy refuse of the liquid ejecting head.

According to an aspect of the present invention, there is provided a liquid ejecting method, comprising: providing a substrate having a heat generating surface for generating heat for generating a bubble in liquid; providing a movable member having a free end; providing an ejection outlet for ejecting the liquid using the generation of the bubble, the ejection outlet being opposed to the substrate with the movable member interposed therebetween; disposing the free end of the movable member at a downstream side with respect to a direction of flow of the liquid to the ejection outlet; and wherein the bubble displaces the free end of the movable member, and grows toward the ejection outlet to eject the liquid.

According to another aspect of the present invention, there is provided a liquid ejecting method, comprising: providing a heat generating surface for generating heat for generating a bubble in liquid; providing a movable member having a free end; providing an ejection outlet for ejecting the liquid using the generation of the bubble, the ejection outlet being opposed to the heat generating surface with the movable member interposed therebetween; disposing the free end of the movable member at a downstream side with respect to a direction of flow of the liquid to the ejection outlet; and wherein the bubble displaces the free end of the movable member, and grows toward the ejection outlet to eject the liquid.

According to a further aspect of the present invention, there is provided a liquid ejection head comprising: a substrate having a heat generating surface for generating heat for generating a bubble in liquid; a movable member having a free end; an ejection outlet for ejecting the liquid using the generation of the bubble, the ejection outlet being opposed to the substrate with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble.

According to a further aspect of the present invention, there is provided a liquid ejection head comprising: a heat generating surface for generating heat for generating a bubble in liquid; a movable member having a free end; an ejection outlet for ejecting the liquid using the generation of the bubble, the ejection outlet being opposed to the heat generating surface with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble.

According to a further aspect of the present invention, there is provided a head cartridge comprising: a liquid ejection head including; a substrate having a heat generating surface for generating heat for generating a bubble in liquid; a movable member having a free end; an ejection outlet for ejecting the liquid using the generation of the bubble, the ejection outlet being opposed to the substrate with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and the head cartridge further comprising: a liquid containing portion for containing the liquid to be supplied to the liquid ejecting head.

According to a further aspect of the present invention, there is provided a head cartridge comprising: a liquid ejection head including: a heat generating surface for generating heat for generating a bubble in liquid; a movable member having a free end; an ejection outlet for ejecting the liquid using the generation of the bubble, the ejection outlet being opposed to the heat generating surface with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and the head cartridge further comprising: a liquid containing portion for containing the liquid to be supplied to the liquid ejecting head.

According to a further aspect of the present invention, there is provided a liquid ejection apparatus comprising: a liquid ejection head including; a substrate having a heat generating surface for generating heat for generating a bubble in liquid; a movable member having a free end; an ejection outlet for ejecting the liquid using the generation of the bubble, the ejection outlet being opposed to the substrate with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and the apparatus further comprising: driving signal supply means for supplying a driving signal for ejecting the liquid.

According to a further aspect of the present invention, there is provided a liquid ejection apparatus comprising: a liquid ejection head including; a substrate having a heat generating surface for generating heat for generating a bubble in liquid; a movable member having a free end; an ejection outlet for ejecting the liquid using the generation of the bubble, the ejection outlet being opposed to the substrate with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and transporting means for transporting a recording material for receiving the liquid ejected from the liquid ejecting head.

According to a further aspect of the present invention, there is provided a liquid ejection apparatus comprising: a liquid ejection head including; a heat generating surface for generating heat for generating a bubble in liquid; a movable member having a free end; an ejection outlet for ejecting the liquid using the generation of the bubble, the ejection outlet being opposed to the heat generating surface with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and the apparatus further comprising: driving signal supply means for supplying a driving signal for ejecting the liquid.

According to a further aspect of the present invention, there is provided a liquid ejection apparatus comprising: a liquid ejection head including; a heat generating surface for generating heat for generating a bubble in liquid; a movable member having a free end; an ejection outlet for ejecting the liquid using the generation of the bubble, the ejection outlet being opposed to the heat generating surface with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and transporting means for transporting a recording material for receiving the liquid ejected from the liquid ejecting head.

According to a further aspect of the present invention, there is provided a head kit comprising: a liquid ejection head including; a substrate having a heat generating surface for generating heat for generating a bubble in liquid; a movable member having a free end; an ejection outlet for ejecting the liquid using the generation of the bubble, the ejection outlet being opposed to the substrate with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and a liquid container containing the liquid to be supplied to the liquid ejecting head.

According to a further aspect of the present invention, there is provided a head kit comprising: a liquid ejection head including; a having a heat generating surface for generating heat for generating a bubble in liquid; a movable member having a free end; an ejection outlet for ejecting the liquid using the generation of the bubble, the ejection outlet being opposed to the heat generating surface with the movable member interposed therebetween; an opposing member cooperable with the movable member to direct the bubble toward the ejection outlet, wherein the opposing member opposes to such a side of the movable member as is near to the heat generating surface when the free end of the movable member is displaced by the bubble; and a liquid container containing the liquid to be supplied to the liquid ejecting head.

According to a further aspect of the present invention, there is provided a liquid ejecting method, comprising: providing a substrate having a heat generating surface for generating heat for generating a bubble in liquid; providing a movable member having a free end; providing an ejection outlet member having an ejection outlet for ejecting the liquid using the generation of the bubble, the ejection outlet being opposed to the substrate with the movable member interposed therebetween; wherein the ejection outlet member and the substrate define a liquid path therebetween and do not cross each other in the path; disposing the free end of the movable member at a downstream side with respect to a direction of flow of the liquid to the ejection outlet; and wherein the bubble displaces the free end of the movable member, and grows toward the ejection outlet to eject the liquid.

According to a further aspect of the present invention, there is provided a liquid ejection head comprising: a substrate having a heat generating surface for generating heat for generating a bubble in liquid; a movable member having a free end; an ejection outlet member having an ejection outlet for ejecting the liquid using the generation of the bubble, the ejection outlet being opposed to the substrate with the movable member interposed therebetween; wherein the ejection outlet member and the substrate define a liquid path therebetween and do not cross each other in the path; an opposing member cooperable with the movable member to direct the bubble toward the ejection outlet, wherein the opposing member opposes to such a side of the movable member as is near to the heat generating surface when the free end of the movable member is displaced by the bubble; the heat generated by the heat generating surface causes film boiling of liquid to create the bubble.

According to a further aspect of the present invention, there is provided a recording system using the recording apparatus.

According to the present invention, a movable member having a free end interposed between a heat generation surface of a heat generating element and an ejection outlet, displaces toward the ejection outlet by the pressure produced by the bubble generated by the heat generation surface. As a result, the movable member cooperates with a member opposed thereto, and concentrates the pressure produced by the bubble toward the ejection outlet as if it squeeze the fluid communication path between the heat generation surface and the ejection outlet. Therefore, the liquid can be ejected with high ejection efficiency, high ejection power, and high shot accuracy onto the recording material. The movable member is also effective to reduce the influence of the back wave, and therefore, the refilling property of the liquid can be improved. Therefore, there is provided the high responsivity, stable growth of the bubble and the stable ejection property of the liquid droplet during continuous liquid ejections, thus accomplishing high speed recording and high image quality recording.

By using the liquid which is easy to generate the bubble and which does not easily produce accumulated material such as cogation in the liquid ejecting head in the two-flow-path structure, the latitude of the selection of the ejection liquid is increased. Additionally liquid which is relatively influenced by heat is usable without the influence.

According to the manufacturing method of the liquid ejecting head of the present invention, such liquid ejecting heads can be manufactured with high precision, with smaller number of parts at low cost.

The present invention provides a recording system or liquid ejecting device with high ejection efficiency.

According to the present invention, the head can be reused.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 12 is a schematic sectional view of a major part of a liquid ejecting head according to an embodiment of the present invention.

FIG. 13A is a schematic sectional view and a partial schematic top plan view of a liquid ejecting head according to an embodiment of the present invention.

FIG. 13B is a schematic sectional view and a partial schematic top plan view of a liquid ejecting head according to the embodiment of the present invention.

DESCRIPTION OF THE PREFERRED EMBODIMENT

Referring to the accompanying drawings, the embodiments of the present invention will be described.

(Embodiment 1)

Figure 1:
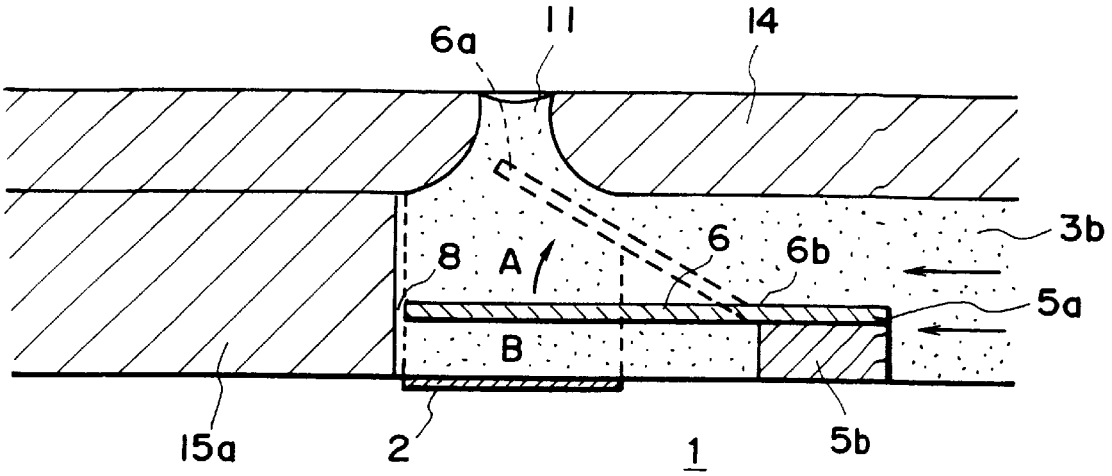
FIG. 1 is a schematic sectional view of a major part of a liquid ejecting head according to an embodiment.
Figure 2:
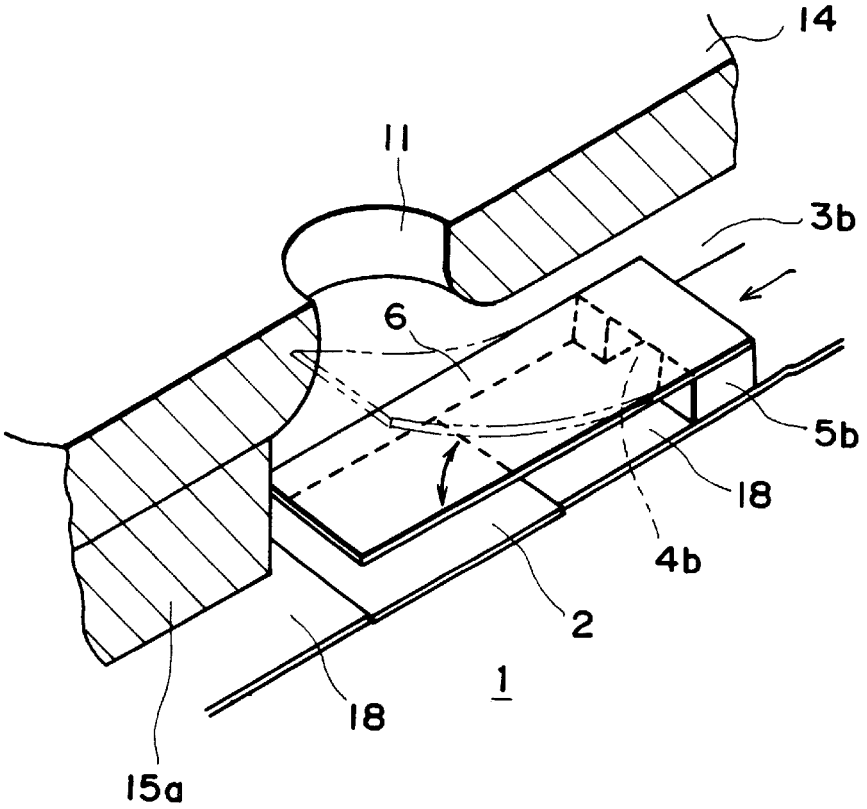
FIG. 2 is a partial schematic partly broken perspective view of a major part of a liquid ejecting head according to an embodiment of the present invention.

FIG. 1 is a schematic cross-sectional view of a liquid ejecting head according to an embodiment of the present invention. FIG. 2 is a FIG. 2 is a partly broken schematic partial view of the liquid ejecting head of FIG. 1.

The liquid ejecting head of this embodiment is a so-called side shooter type head, wherein the ejection outlet 11 is faced substantially parallel to a heat generation surface of the heat generating element 2. The heat generating element 2 has a size of 48 $\mu$m×46 $\mu$m and is in the form of a heat generating resistor. It is mounted on a substrate 1, and generates thermal energy used to generate a bubble by film boiling of liquid as disclosed in U.S. Pat. No. 4,723,129. The ejection outlet 11 is formed in an orifice plate 14 which is an ejection outlet portion material. The orifice plate 14 is manufactured from nickel through electro-forming.

A liquid flow path 3*b* is provision between the orifice plate 14 and the substrate 1 so that it is directly in fluid communication with the ejection outlet 11 to flow the liquid therethrough. In this embodiment, water base ink (mixture liquid of water and ethanol) as liquid to be ejected.

The liquid flow path 3*b* is provided with a movable portion 6 in the form of a flat plate cantilever so as to cover the heat generating element 2 and to face it. Here, the movable portion is called "movable member". The movable portion 6 is positioned adjacent an upward projection space of the heat generation surface in a direction perpendicular to the heat generation surface of the heat generating element 2. The movable portion 6 is of elastic material such as metal. In this embodiment, it is of nickel having a thickness of 5 $\mu$m. An one end 5*a* of the movable portion 6 is supported and fixed on a supporting member 5*b*. The supporting member 5*b* is formed by patterning photosensitive resin material on the substrate 1. Between the movable portion 6 and the heat generating surface, this is provided a clearance of approx. 15 $\mu$m.

Reference numeral 15*a* designates a wall member as an opposing member opposed to such a surface of the movable portion 6 as is nearer to the heat generation surface when the movable portion 6 is opened. The wall member 15*a* and a free end 6*a* of the movable portion 6 are opposed to each other with a gap therebetween of approx. 2 $\mu$m in the form of a slit 8. The movable portion 6 has a fixed end (fulcrum) at an upstream side with respect to the flow of the liquid from a common liquid chamber to the ejection outlet 11 through the supply passage 4*b* and the movable portion 6, and has a free end 6*a* at the downstream side. The fixed end 6*b* functions as a base portion (fulcrum) upon opening of the movable portion 6.

In this embodiment, the slit 8 is narrow enough to prevent the bubble from expanding therethrough before the movable portion 6 displaces. Thus, it is formed around the movable portion 6 but provides substantial sealed structure. At least the free end 6*a* of the movable portion 6 is disposed within a region to which the pressure due to the bubble extends. In FIG. 1, "A" designates an upper side region (ejection outlet side) of the movable portion 6 in a stable state, and "B" designates a lower side (heat generating element side) region.

When heat is generated at the heat generation surface of the heat generating element 2, and a bubble is generated in the region B, the free end 6*a* of the movable portion 6 is instantaneously moved in the direction of the arrow in FIG. 1 namely toward the region A with the base portion 6*b* functioning as a fulcrum by the pressure resulting from the generation and growth of the bubble and by the expanding bubble per se. By this, the liquid is ejected out through the ejection outlet 11.

In FIG. 2, reference numeral 18 designates wiring electrode for applying an electric signal to the heat generating element 2 which is an electrothermal transducer, and it is mounted on the substrate 1.

The description will be made as to ejecting operation of the liquid ejecting head according to this embodiment. FIGS. 3A–3D are schematic sectional views illustrating ejecting operation of the liquid ejecting head according to this embodiment. In FIGS. 3A–3D, supporting member 5*b* is omitted for simplicity.

Figure 3A:
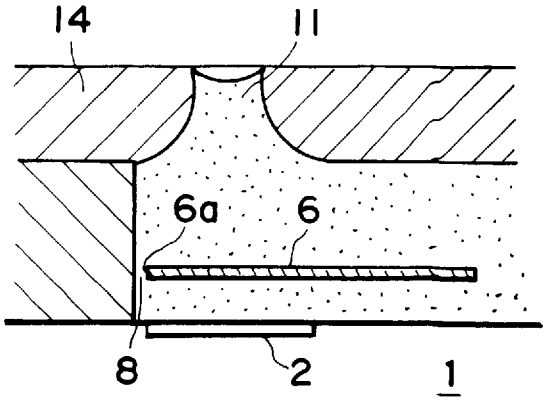
FIG. 3A is a schematic sectional view illustrating liquid ejection state of a liquid ejecting head according to an embodiment of the present invention.

FIG. 3A shows a state in which the heat generating element 2 has not yet been supplied with energy such as electric energy, namely, in which the heat generating element has not yet generated the heat (initial state). As shown FIG. 3A, the free end 6*a* is opposed to the slit 8 of a predetermined size.

Figure 3B:
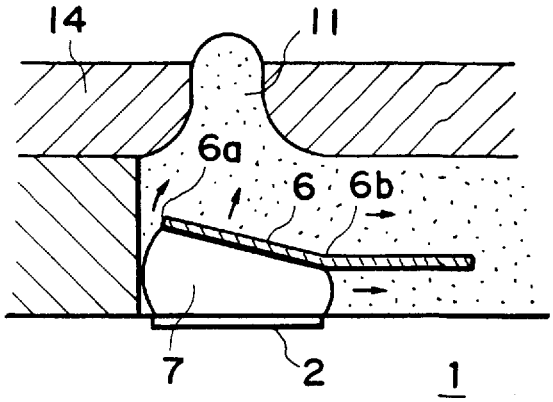
FIG. 3B is a schematic sectional view illustrating liquid ejection state of a liquid ejecting head according to the embodiment of the present invention.

FIG. 3B shows a state in which the heat generating element 2 is supplied with the electric energy or the like to generate the heat, which produces a bubble 7 by film boiling, and the bubble is growing. The pressure resulting from the generation of the bubble and the growth thereof is mainly propagated to the movable portion 6. The mechanical displacement of the movable portion 6 is contributable to the ejection of the ejection liquid from the ejection outlet.

Figure 3C:
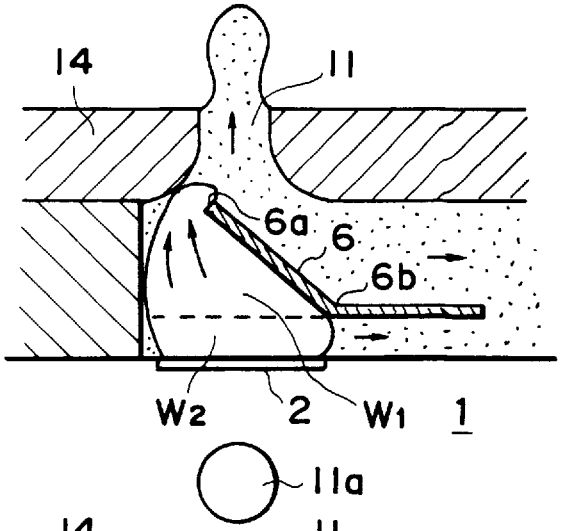
FIG. 3C is a schematic sectional view illustrating liquid ejection state of a liquid ejecting head according to the embodiment of the present invention.

FIG. 3C shows a state in which the bubble 7 has further grown. As will be understood, the movable portion 6 is further displaced toward the ejection outlet with the growth of the bubble 7. By the displacement of the movable portion 6, the ejection outlet side region A and the heat generating element side region B are in much freer communication with each other than the initial state. In this state, the fluid communication path between the heat generation surface and the ejection outlet is choked to a proper extent by the movable portion 6 so as to concentrate the force of the bubble expansion toward the ejection outlet. In this manner, the pressure wave resulting from the growth of the bubble is transmitted concentratedly in the upward direction. By such direct propagation of the pressure wave and the mechanical displacement of the movable portion 6 described in conjunction with FIG. 4B, the ejection liquid is ejected at high speed and with high ejection power and further with high ejection efficiency through the ejection outlet 11 in the form of a droplet 11*a* (FIG. 3D).

In FIG. 3C, a part of the bubble generated at the heat generating element side region B extends to the ejection outlet side region A. The ejection power can be further increased if the clearance from the surface of the substrate 1 or the heat generation surface of the heat generating element 2 to the movable portion 6 is so selected as to permit the bubble to extend into the ejection outlet side region A. In order to permit the bubble to extend toward the ejection outlet beyond the initial position of the movable portion 6, it is desirable that the height of the heat generating element side region B is smaller than the height of the maximum bubble state, more particularly several $\mu$m–30 $\mu$m.

Figure 3D:
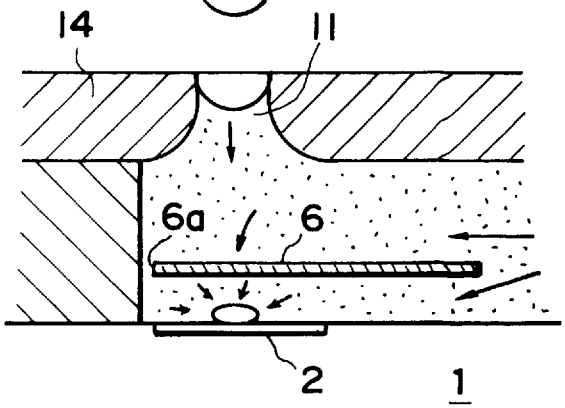
FIG. 3D is a schematic sectional view illustrating liquid ejection state of a liquid ejecting head according to the embodiment of the present invention.

FIG. 3D shows a state in which the bubble 7 is collapsing by the decrease of the inside pressure. The movable portion 6 restores its initial position by the negative pressure resulting from the contraction of the bubble and the restoring force due to the spring property of the movable portion per se. With this, the liquid flow path 3*b* is quickly supplied with the amount of the liquid ejected out. In the liquid flow path 3*b*, there is hardly any influence of the back wave due to the bubble, and liquid supply is carried out concurrently with the closing of the movable portion 6, and therefore, the liquid supply is not obstructed by the movable portion.

The description will be made as to refilling of the liquid in the liquid ejecting head of this embodiment.

When the bubble 7 is in the collapsing process after the maximum volume thereof is reached, the volume of the liquid compensating for the disappeared bubble volume flows both from the ejection outlet 11 side and the liquid flow path 3*b* side. The volume of the bubble at the upper side (ejection outlet side) beyond the initial position of the movable portion 6 is W1, and that of the lower side (heat generating element side) is movable portion (W1+W2=W). When the movable portion 6 restores its initial position, the retraction of the meniscus at the ejection outlet for compensating a part of W1 stops, thereafter, the compensation for the remaining W2 is mainly effected by the liquid supply between the movable portion 6 and the heat generation surface. By this, the retraction of the meniscus at the ejection outlet can be reduced.

In this embodiment, the compensation of the volume W2 can be forcedly effected mainly through the liquid flow path 3*b* along the heat generation surface of the heat generating element, using the pressure change upon the collapse of bubble, and therefore, the quicker refilling is possible. In the case that the refilling is effected using the pressure upon the collapse of bubble in a conventional head, the vibration of the meniscus is large with the result of the deterioration of the image quality, but in this embodiment, the vibration of the meniscus can be minimized since the communication between the ejection outlet side region A and the heat generating element side region B is suppressed. By this, the improvement of the image quality and the high speed recording are expected.

The surface of the substrate 1 is substantially flush with the heat generation surface of the heat generating element 2, that is, the heat generating element surface is not stepped down. In such a case, the supply of the liquid to the region B occurs along the surface of the substrate 1. Therefore, the stagnation of the liquid on the heat generation surface of the heat generating element 2 is suppressed, and the precipitated bubble resulting from the dissolved gasses or the residual bubble having not collapsed, are removed, and the heat accumulation in the liquid is not too much. Therefore, more stabilized generation of the bubble can be repeated at high speed. In this embodiment, the surface of the substrate 1 is of flat inner wall, but this is not limiting if the inner wall has such a smooth surface that the liquid does not stagnate and that an eddy flow does not occur in the liquid.

(Embodiment 2)

Figure 4:
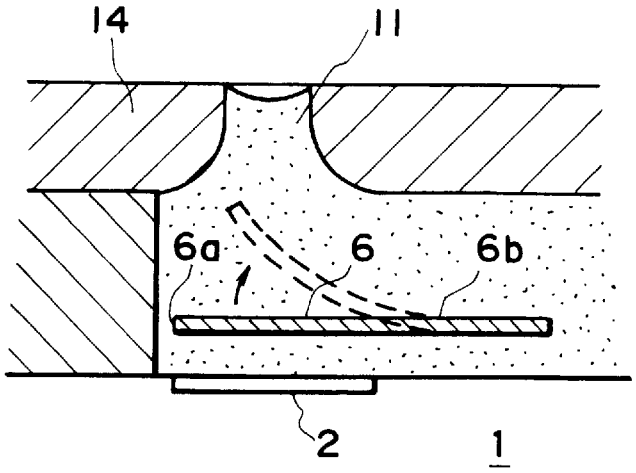
FIG. 4 is a schematic sectional view of a major part of a liquid ejecting head according to an embodiment of the present invention.

FIG. 4 is a schematic sectional view of a major part of another embodiment of the liquid ejecting head of the present invention. In FIG. 4, supporting member 5*b* is omitted for simplicity.

This embodiment is different from Embodiment 1 in that the movable portion 6 is thin to provide higher flexibility. By this, as shown in FIG. 4 by the broken line, the movable portion 6 displaced by the bubble is slightly bent toward the ejection outlet 11. If the movable portion is flexible, the movable portion can be deflected to a great extent even with relatively low bubble generation pressure, so that the bubble generation pressure can be further efficiently directed to the ejection outlet. In this embodiment, too, a high ejection power and high ejection efficiency liquid ejecting head is provided.

(Embodiment 3)

Figure 5:
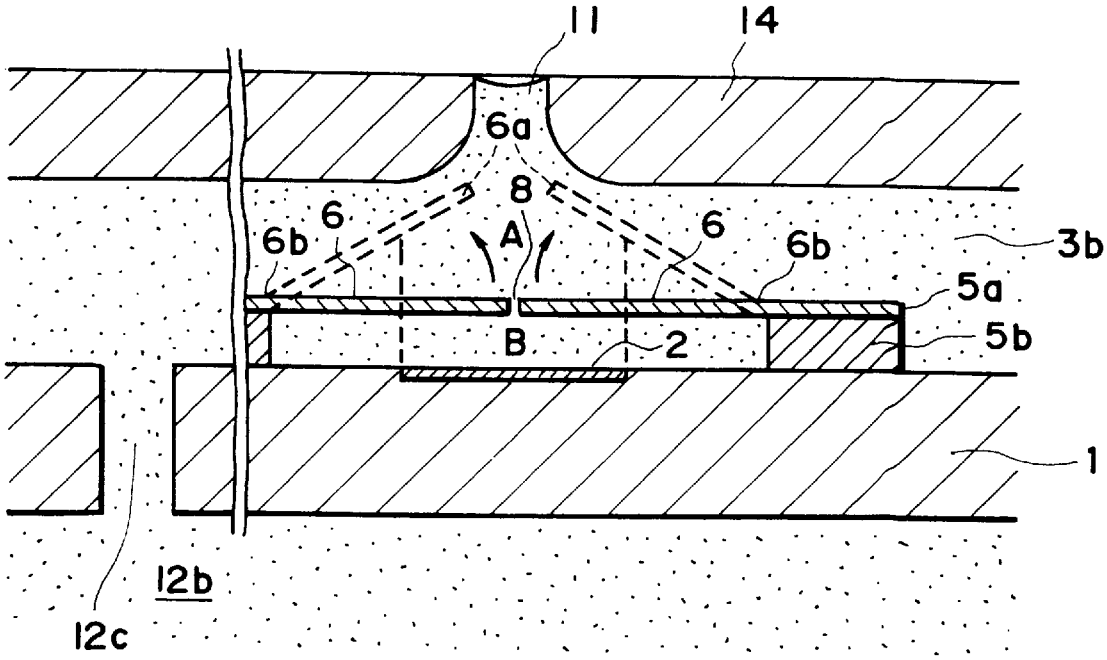
FIG. 5 is a schematic sectional view of a major part of a liquid ejecting head according to an embodiment of the present invention.
Figure 6:
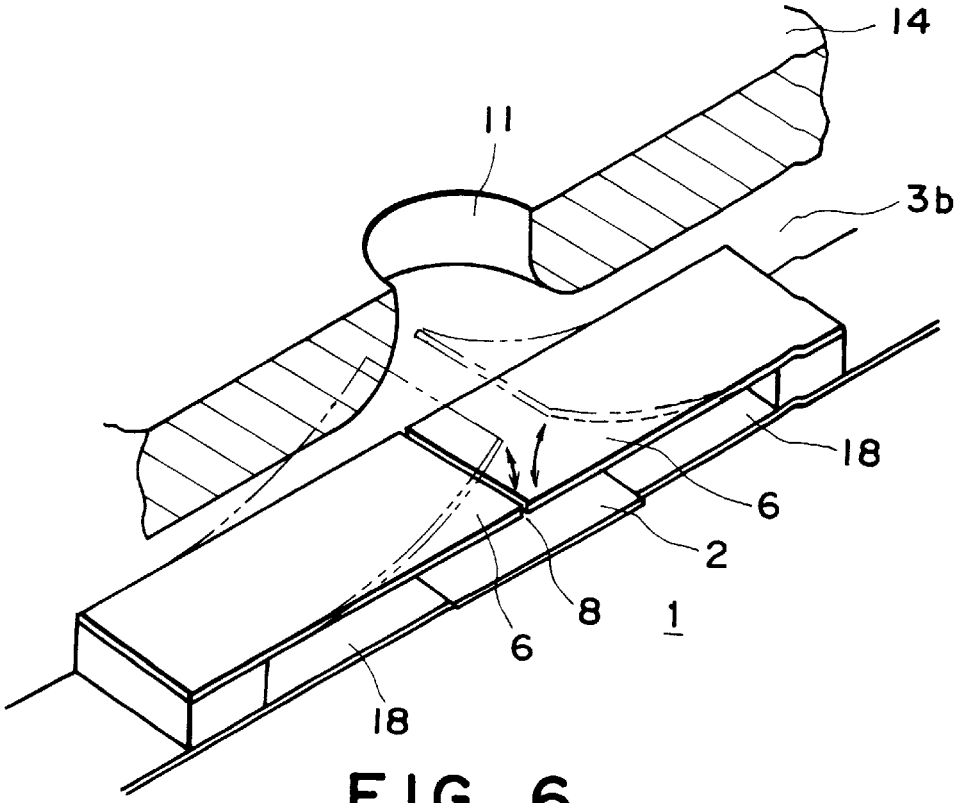
FIG. 6 is a partly broken schematic perspective view of a major part of a liquid ejecting head according to an embodiment of the present invention.

FIG. 5 is a schematic sectional view of a major part of another embodiment. FIG. 6 is a partial schematic partly broken perspective view of a liquid ejecting head shown in FIG. 5. The movable portion 6 of the head of this embodiment is not of a single structure but has a couple structure. The pressure of the bubble displaces a pair of movable portions 6 to permit the pressure to transmit toward the ejection outlet 11 disposed above the movable portion 6. One of the movable portions 6 function as the movable member and the on the other hand functions as an opposing member, so that the bubble generation pressure is efficiently directed toward the ejection outlet. In this embodiment, too, a high ejection power and high ejection efficiency liquid ejecting head is provided.

(Embodiment 4)

Figure 7:
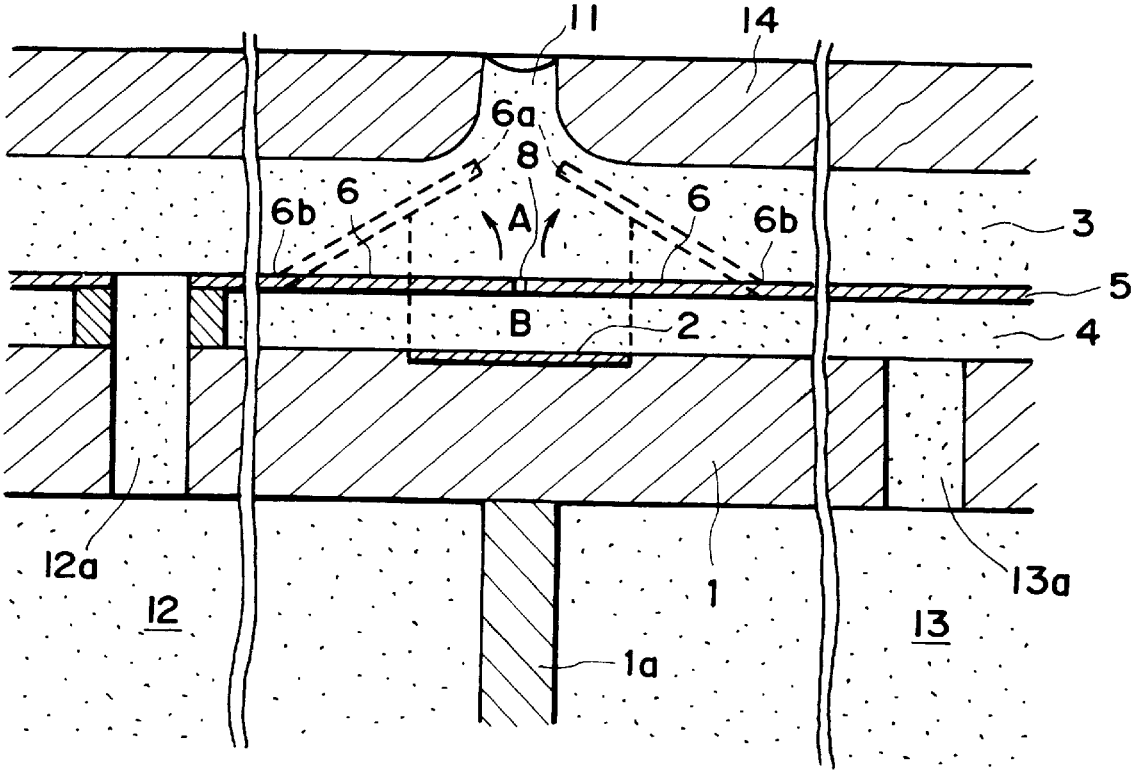
FIG. 7 is a schematic sectional view of a major part of a liquid ejecting head according to an embodiment of the present invention.
Figure 8:
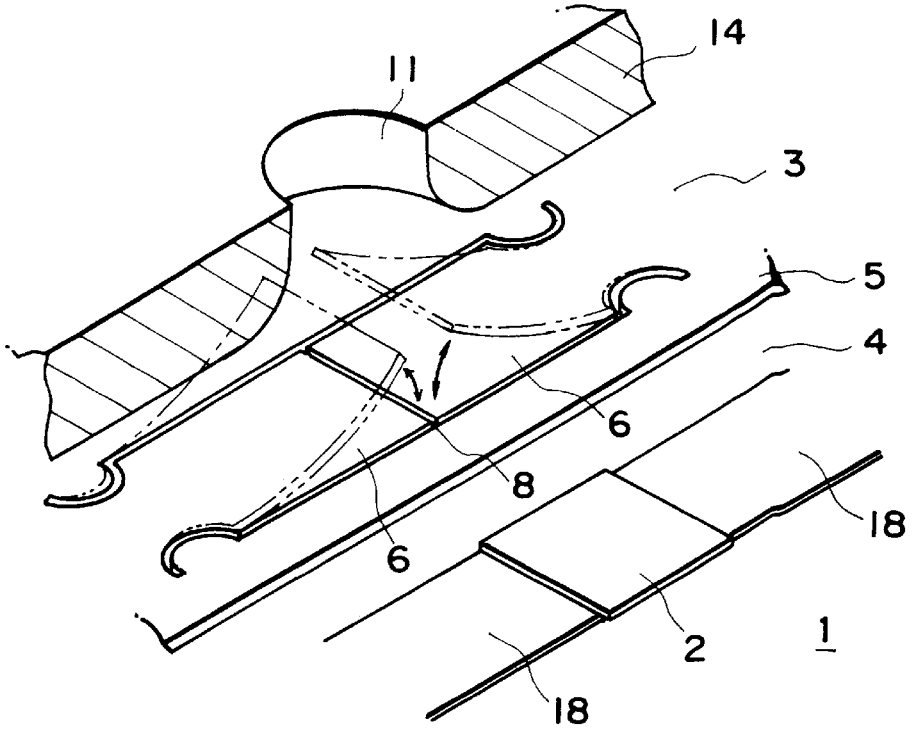
FIG. 8 is a partially broken schematic perspective view of a liquid ejection head according to an embodiment of the present invention.

FIG. 7 is an is a schematic cross-sectional view of a liquid ejecting head of a further embodiment of the present invention. FIG. 8 is schematic portion partly broken perspective view of a liquid ejecting head of FIG. 7.

The liquid ejecting head of this embodiment is a side shooter type head wherein the heat generating element 2 is faced to the ejection outlet 11. The heat generating element 2 has a size of 48 $\mu$m×46 $\mu$m and is in the form of a heat generating resistor. It is mounted on a substrate 1, and generates thermal energy used to generate a bubble by film boiling of liquid as disclosed in U.S. Pat. No. 4,723,129. The ejection outlet 11 is provided in an orifice plate 14 which is an ejection outlet portion material. The orifice plate 14 is of nickel and manufactured through electro-forming.

A first liquid flow path 3 is provided below the orifice plate 14 so that it is directly in fluid communication with the ejection outlet 11. On the other hand, on the substrate 1, a second liquid flow path 4 is provision for the flow of the bubble generation liquid. Between the first liquid flow path 3 and the second liquid flow path 4, a partition or separation wall 5 for separating the liquid flow paths is provided. The separation wall 5 is of elastic material such as metal. In this embodiment, the separation wall 5 is of nickel having a thickness of 5 $\mu$m. The separation wall 5 separates the ejection liquid in first liquid flow path 3 and the bubble generation liquid in the second liquid flow path 4.

The ejection liquid is supplied to the first liquid flow path 3 through the first supply passage 12*a* from the first common liquid chamber 12 containing the ejection liquid. The bubble generation liquid is supplied to the second liquid flow path 4 through the second supply passage 13*a* from the second common liquid chamber 13 containing the bubble generation liquid. The first common liquid chamber 12 and the second common liquid chamber 13 are separated by a partition 1*a*. In this embodiment, the ejection liquid supplied to the first liquid flow path 3 and the bubble generation liquid supplied to the second liquid flow path 4 are both water base ink (mixed liquid of ethanol and water).

The separation wall 5 is disposed adjacent the portion of the projected space of the heat generation surface of the heat generating element 2 perpendicular to the heat generation surface, and has a pair of movable portions 6 of flat plate cantilever configuration, one of which is a movable member and the other is an opposing member opposed to the movable member. The movable portion 6 and the heat generating surface a disposed with a clearance of 15 $\mu$m approx. The free ends 6*a* of the movable portions 6 are opposed to each other with a gap of approx. 2 $\mu$m (slit 8). Designated by 6*b* is a base portion functioning as a base portion upon opening of the movable portions 6. Slit 8 is formed in a plane including a line connecting a center portion of the heat generating element 2 and the center portion of the ejection outlet 11. In this embodiment, the slit 8 is so narrow that the bubble does not extend through the slit 8 around the movable portions 6 before the movable portion 6 is displaced, when the bubble growths. At least the free end 6*a* of the movable portion 6 is disposed within a region to which the pressure due to the bubble extends. In FIG. 7, "A" designates an upper side region(ejection outlet side) of the movable portion 6 in a stable state, and "B" designates a lower side(heat generating element side) region.

When heat is generated at the heat generation surface of the heat generating element 2, and a bubble is generated in the region B, the free end 6*a* of the movable portion 6 is instantaneously moved in the direction of the arrow in FIG. 1 namely toward the region A with the base portion 6*b* functioning as a fulcrum by the pressure resulting from the generation and growth of the bubble and by the expanding bubble per se. By this, the liquid is ejected out through the ejection outlet 11.

Designated by reference numeral 18 in FIG. 8 is a wiring electrode for applying the electric signal to the heat generating element 2 which is an electrothermal transducer mounted on the substrate 1.

Figure 9A:
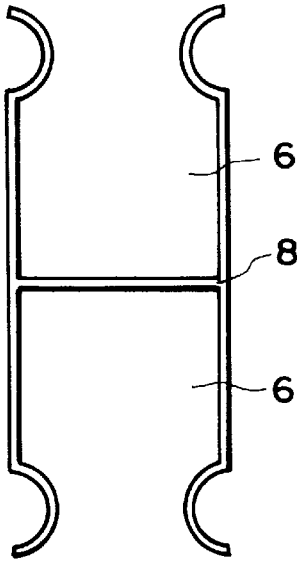
FIG. 9A is a schematic top plan view of a heat generating element and movable portion or the like used in a liquid ejecting head according to an embodiment of the present invention.
Figure 9B:
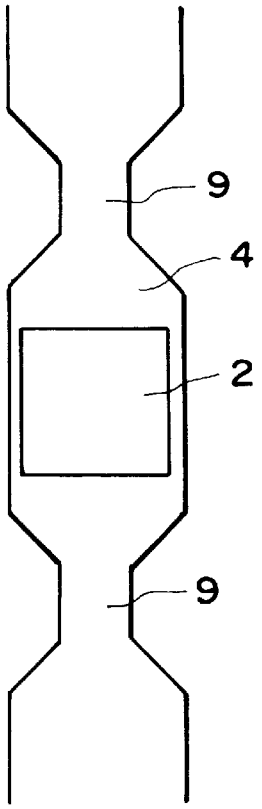
FIG. 9B is a schematic top plan view of a heat generating element and movable portion or the like used in a liquid ejecting head according to the embodiment of the present invention.
Figure 9C:
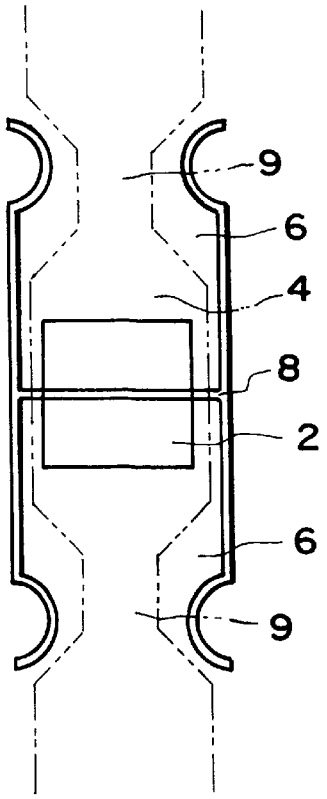
FIG. 9C is a schematic top plan view of a heat generating element and movable portion or the like used in a liquid ejecting head according to the embodiment of the present invention.

The description will be made as to the positional relation between the movable portion 6 and the second liquid flow path 4 in this embodiment. FIG. 9A is a schematic top plan view of the movable portion 6 as seen from the orifice plate 14 side. FIG. 9B is a schematic top plan view of the bottom portion of the second liquid flow path 4, as seen from the separation wall 5 side. FIG. 9C is a schematic top plan view of the movable portion 6 through the second liquid flow path 4, as seen from the orifice plate 14 side. In these Figures, the front side of the sheet of the drawing is an ejection outlet 11 side.

In this embodiment, throat portions 9 are formed on both sides of the heat generating element 2 in the second liquid flow path 4. By the throat portions 9, the adjacent region of the heat generating element 2 of the second liquid flow path 4 has a chamber (bubble generation chamber) structure such that escape of the pressure upon the bubble generation along the second liquid flow path 4 is suppressed.

When a throat portion is provided in the liquid flow path to suppress escape of the pressure upon the bubble generation in a conventional head, the flow path cross-sectional area at the throat portion should not be too small in view of the refilling property of the liquid to be ejected. However, in this embodiment, most of the ejected liquid is the ejection liquid in the first liquid flow path, and the bubble generation liquid in the second liquid flow path having the heat generating element is not ejected so much, and therefore, the filling of the bubble generation liquid into the region B of the second liquid flow path may relatively small. Therefore, the clearance of the flow passage wall in the throat portion 9 may be very narrow, such as several μm. By this, the pressure upon the bubble generation generated in the second liquid flow path 4 can be directed concentratedly toward the movable portion 6 without escape to the circumference. Such pressure can be used as the ejection power through the movable portion 6, and therefore, further high ejection efficiency and ejection power can be accomplished.

The description will be made as to the ejecting operation of the liquid ejecting head in this embodiment. FIG. 10A–FIG. 10D are schematic sectional views of the liquid ejecting head illustrating the ejecting operation in this embodiment. In this embodiment, the ejection liquid to be supplied to the first liquid flow path 3 and the bubble generation liquid to be supplied to the second liquid flow path 4, are the same water base ink.

Figure 10A:
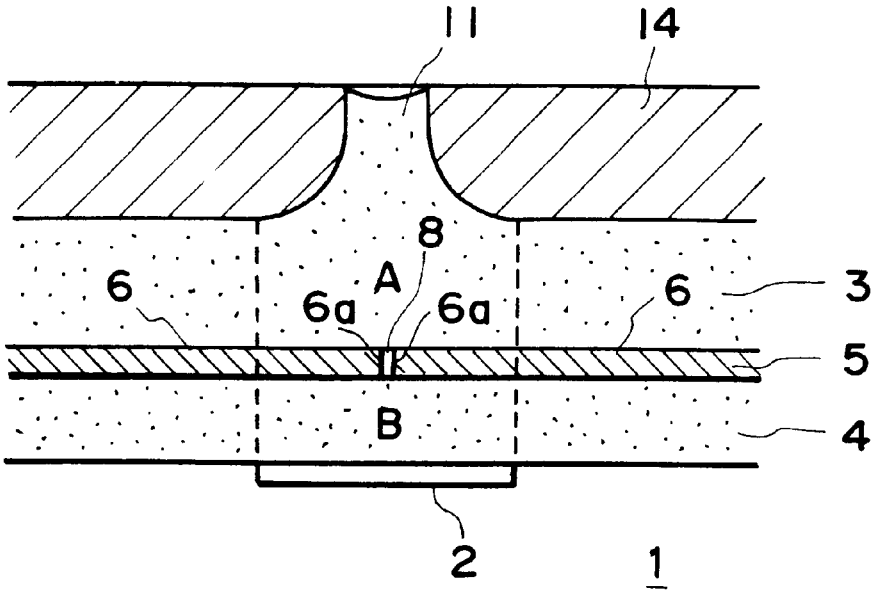
FIG. 10A is a schematic sectional view illustrating liquid ejection state of a liquid ejecting head according to an embodiment of the present invention.

FIG. 10A shows a state before the energy such as the electric energy is applied to the heat generating element 2, namely, the initial state before the heat generating element generates heat. As shown in FIG. 10A, the free ends 6*a* of the separation walls 5 above the heat generating element 2, are faced to each other through a slit 8 to separate the ejection liquid in the first liquid flow path 3 and the bubble generation liquid in the second liquid flow path 4.

Figure 10B:
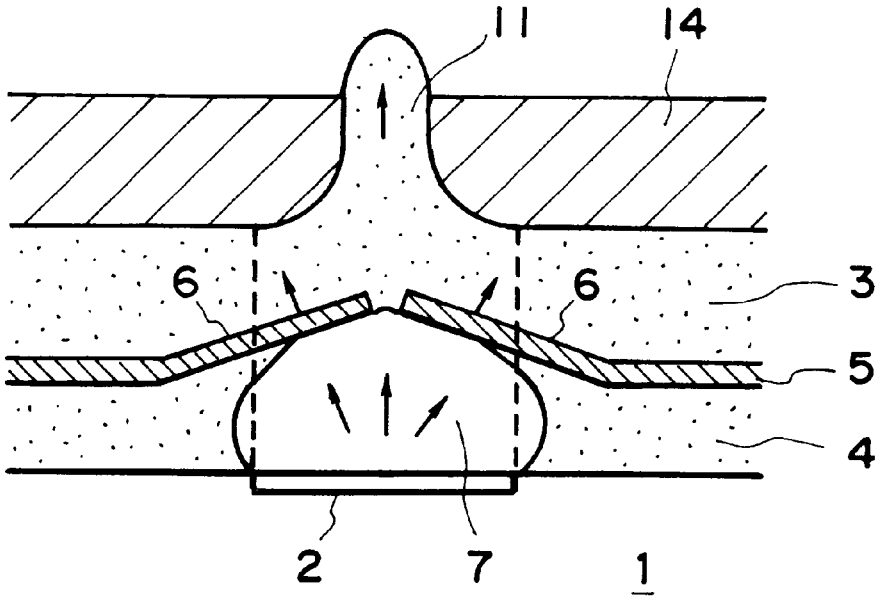
FIG. 10B is a schematic sectional view illustrating liquid ejection state of a liquid ejecting head according to the embodiment of the present invention.

FIG. 10B shows a state in which the heat generating element 2 is supplied with the electric energy or the like, and the heat generating element 2 generate the heat which produces film boiling in the liquid so that the bubble 7 is generated and is expanded. The pressure resulting from the generation and the growth of the bubble is mainly propagated to the movable portion 6. The mechanical displacement of the movable portion 6 is contributable to the ejection of the ejection liquid from the ejection outlet.

Figure 10C:
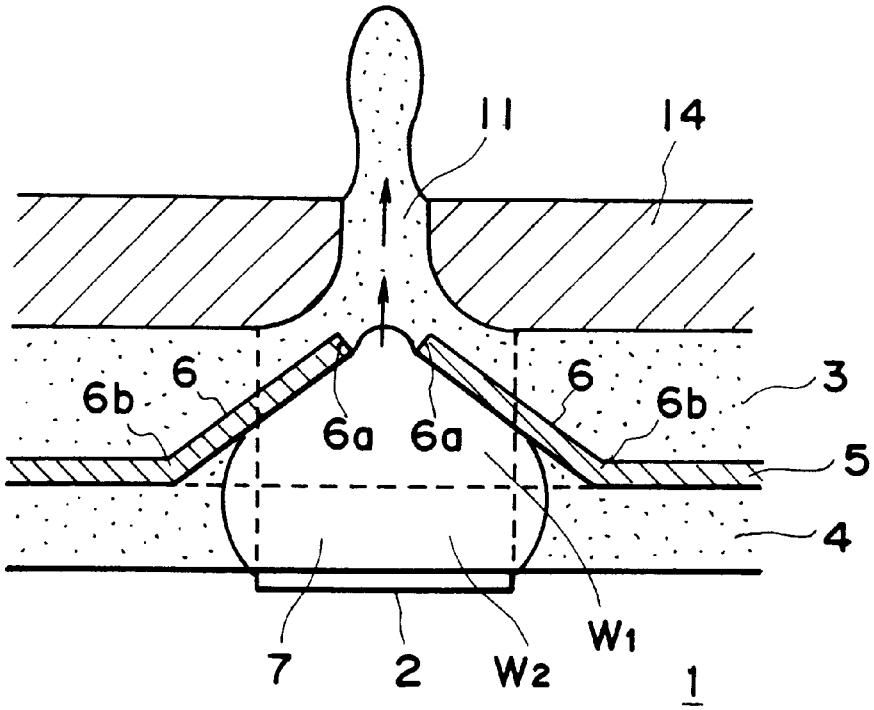
FIG. 10C is a schematic sectional view illustrating liquid ejection state of a liquid ejecting head according to the embodiment of the present invention.

FIG. 10C shows a state wherein the bubble 7 has further grown. With the growth of the bubble 7, the movable portion 6 is further displaced toward the first liquid flow path 3 side with its base portion 6*b* functioning as fulcrum. By the displacement of the movable portion 6, the first liquid flow path 3 and the second liquid flow path 4 are in substantial fluid communication with each other. In this state, the fluid communication path between the heat generation surface and the ejection outlet is choked to a proper extent by the movable portion 6 so as to concentrate the force of the bubble expansion toward the ejection outlet. In this manner, the pressure wave produced by the growth of the bubble is concentratedly transmitted right upward toward the ejection outlet 11 in fluid communication with the first liquid flow path 3. By the direct propagation of the pressure wave and the mechanical displacement of the movable portion 6 described in conjunction with FIG. 10B, the ejection liquid is ejected through the ejection outlet 11 at high speed and with high ejection power and with high ejection efficiency as a droplet 11*a* (FIG. 10D).

In FIG. 10C, with the displacement of the movable portion 6 to the first liquid flow path 3 side, a part of the bubble generated at the region B in the second liquid flow path 4 extends into the first liquid flow path 3 side. Thus, the height of the second liquid flow path 4 (a clearance from the surface of the substrate 1 or the heat generating surface of the heat generating element 2 to the movable portion 6) is such that the bubble extending into the first liquid flow path 3 side, by which the ejection power is further improved. In order to extend the bubble into the first liquid flow path 3, it is desirable the height of the second liquid flow path 4 is made smaller than the height of the maximum bubble, for example, several μm–30 μm.

Figure 10D:
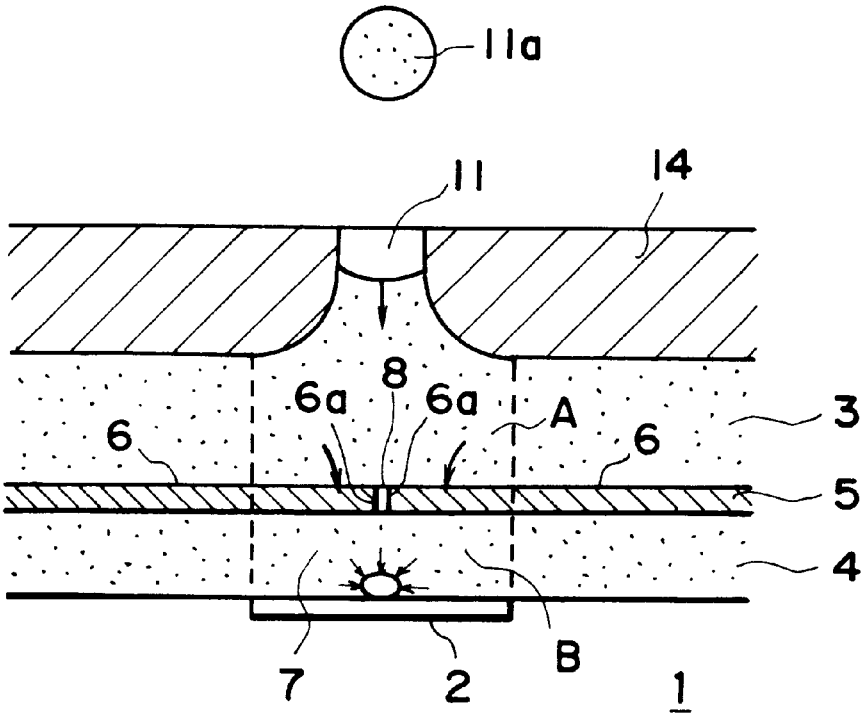
FIG. 10D is a schematic sectional view illustrating liquid ejection state of a liquid ejecting head according to the embodiment of the present invention.

FIG. 10D shows a state in which the bubble 7 is collapsing by the decrease of the inside pressure. The movable portion 6 restores its initial position by the negative pressure resulting from the contraction of the bubble and the restoring force due to the spring property of the movable portion per se. With this, the first liquid flow path 3 is quickly supplied with the amount of the liquid ejected out. In the first liquid flow path 3, there is hardly any influence of the back wave due to the bubble, and liquid supply is carried out concurrently with the closing of the movable portion 6, and therefore, the liquid supply is not obstructed by the movable portion. Accordingly, the inside in the FIG. 10D is not pressure so much, and therefore, a small amount of decrease is enough.

The description will be made as to the refilling of the liquid in the liquid ejecting head according to this embodiment.

When the bubble 7 is in the bubble collapse process after the maximum volume thereof, the volume of the liquid compensating for the disappeared bubble volume flows both from the ejection outlet 11 side side, the first liquid flow path 3*b* side and the second liquid flow path 4. The volume of the bubble at the upper side (ejection outlet side) beyond the initial position of the movable portion 6 is W1, and that of the lower side (heat generating element side) is movable portion (W1+W2=W). When the movable portion 6 restores its initial position, the retraction of the meniscus at the ejection outlet for compensating a part of W1 stops, thereafter, the compensation for the remaining W2 is mainly effected by the liquid supply in the second liquid flow path 4. By this, the degree of retraction of the meniscus in the ejection outlet, can be suppressed.

In this embodiment, the compensation of the volume W2 can be forcedly effected mainly through the second liquid flow path along the heat generation surface of the heat generating element, using the pressure change upon the collapse of bubble, and therefore, the quicker refilling is possible. In the case that the refilling is effected using the pressure upon the collapse of bubble in a conventional head, the vibration of the meniscus is large with the result of the deterioration of the image quality, but in this embodiment, the vibration of the meniscus can be minimized since the communication between the region of the first liquid flow path 3 of the ejection outlet side and the second liquid flow path 4, is suppressed by the movable portion. By this, the improvement of the image quality and the high speed recording are expected.

The surface of the substrate 1 is substantially flush with the heat generation surface of the heat generating element 2, that is, the heat generating element surface is not stepped down. In such a case, the supply of the liquid to the region B occurs along the surface of the substrate 1. Therefore, the stagnation of the liquid on the heat generation surface of the heat generating element 2 is suppressed, and the precipitated bubble resulting from the dissolved gasses or the residual bubble having not collapsed, are removed, and the heat accumulation in the liquid is not too much. Therefore, more stabilized generation of the bubble can be repeated at high speed. In this embodiment, the surface of the substrate 1 is of flat inner wall, but this is not limiting if the inner wall has such a smooth surface that the liquid does not stagnate and that an eddy flow does not occur in the liquid.

Figure 11A:
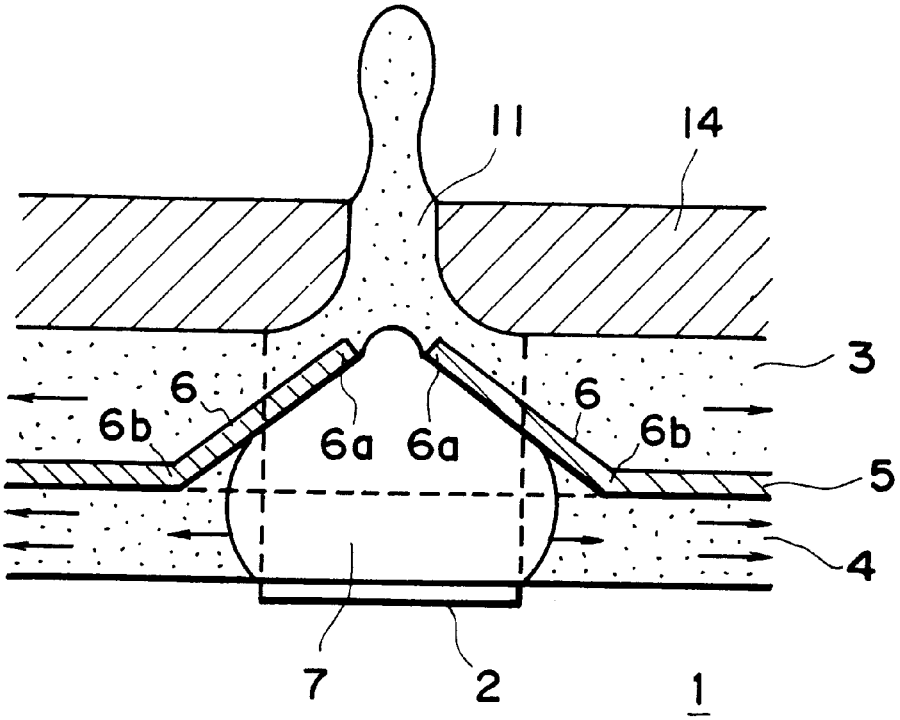
FIG. 11A is a schematic sectional view illustrating pressure propagation from a bubble produced in a liquid ejecting head according to an embodiment of the present invention.
Figure 11B:
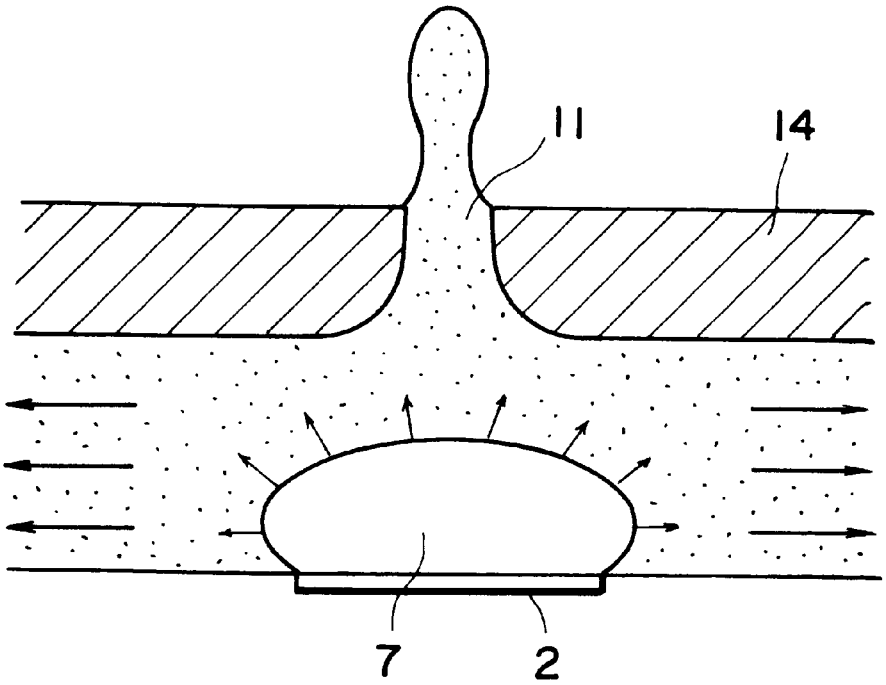
FIG. 11B is a schematic sectional view illustrating pressure propagation from a bubble in a conventional liquid ejecting head.

The description will be made as to the pressure propagation from the bubble in the liquid ejecting head of this embodiment, as compared with a conventional example. FIG. 11A is a schematic sectional view illustrating pressure propagation from the bubble in the liquid ejecting head of this embodiment. FIG. 11B is a schematic sectional view illustrating pressure propagation from the bubble in the liquid ejecting head of the conventional.

In a representative conventional head showed in FIG. 11B, there is not obstructing material against the propagation of the pressure produced by the bubble 7, in the propagation direction. Therefore, the direction of the pressure propagation of the bubble is widely scattered along the substantially normal line direction of the surface of the bubble, as indicated by $V_1$–$V_8$. Among these directions, the pressure component directed to the ejection outlet which is most influential to the liquid ejection, is $V_8$–$V_6$, namely, the pressure propagation component close to the ejection outlet. Particularly, $V_4$ and $V_5$ are closest to the ejection outlet, so that they work efficiently for the liquid ejection, but $V_3$ and $V_6$ have relatively small component directed to the ejection outlet. Here, $V_A$ and $V_B$ are the pressure propagation component in the opposite direction along the liquid flow path.

In the case of this embodiment showed in FIG. 11A, the movable member 6 directs the pressure propagation component $V_3$–$V_6$ of the bubble toward the ejection outlet, and therefore, the pressure of the bubble 7 acts directly and efficiently. The bubble per se growths toward the ejection outlet. In this manner, the movable portion controls not only the pressure propagation direction but also the growth of the bubble per se, so that the ejection efficiency, ejection power, ejection speed and so on are significantly ejection powered.

Here, $V_{A1}$ and $V_{B1}$ are pressure components along the first liquid flow path in the opposite directions from each other, and $V_A$ and $V_B$ are pressure components along the second liquid flow path in the opposite directions from each other. In this embodiment, the movable portion 6 suppresses the back wave, and therefore, $V_{A1}$ and $V_{B1}$ are smaller than in the conventional device. The bubble is directed toward the ejection outlet, and therefore, $V_A$ and $V_B$ are smaller than in the conventional device. As a result, $V_{A1}+V_A$ and $V_{B1}+V_B$ are smaller than $V_A$ and $V_B$ in the conventional device.

(Embodiment 5)

FIG. 12 is a schematic sectional view of a major part of a liquid ejecting head according to another embodiment of the present invention. This embodiment is different from Embodiment 4 in that the movable portion 6 is thin to give higher flexibility. By this, as shown in FIG. 12 by the broken line, the movable portion 6 displaced by the bubble is slightly bent toward the ejection outlet 11. If the movable portion is flexible, the movable portion can be deflected to a great extent even with relatively low bubble generation pressure, so that the bubble generation pressure can be further efficiently directed to the ejection outlet. In this embodiment, too, a high ejection power and high ejection efficiency liquid ejecting head is provided.

(Embodiment 6)

FIG. 13A is a schematic sectional view of a major part of a liquid ejecting head of the present invention according to a further embodiment. FIG. 13B is a schematic top plan view of the movable portion used in this embodiment, as seen from the ejection outlet side. This embodiment is different from Embodiment 4 in that a trench or pit type liquid passage 4*a* enclosed by walls in four sides is in place of the second liquid flow path 4. In this embodiment, after liquid ejection, the liquid is supplied into the pit type liquid passage 4*a* mainly from the first liquid flow path 3 through the opening 6*c* in the movable member 6. The size of the opening 6*c* will suffice if it permits flow of the ink without escaping the bubble.

In this embodiment, the escape of the bubble generation pressure toward upstream side along the lower part of the movable portion 6. Furthermore, upon the collapse of bubble, the amount of the ink to be refilled is only the one corresponding to the volume of the pit type liquid passage, so that the refilling amount may be small, and the high speed responsivity can be accomplished. In this embodiment, the high ejection power and high ejection efficiency liquid ejecting head can be prevented.

(Embodiment 7)

Figure 14A:
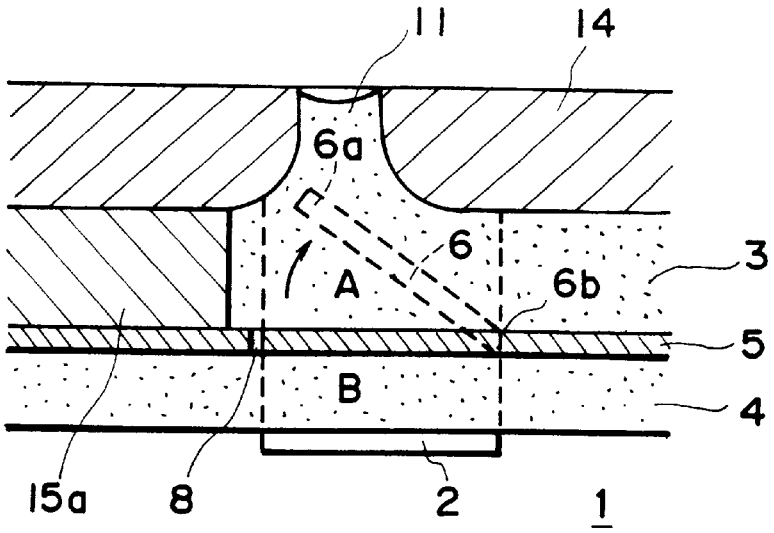
FIG. 14A is a schematic sectional view illustrating liquid ejection state in a liquid ejecting head according to an embodiment of the present invention.

FIG. 14A is a schematic sectional view of a major part of a liquid ejecting head according to a further embodiment of the present invention. The movable portion 6 of the head of this embodiment is not a dual type, but a single type. The first liquid flow path 3 at the free end 6*a* side of the movable portion 6 is closed by a wall 15*a* (opposing member opposed to the movable member), so that the pressure produced by the bubble expands toward the ejection outlet 11 thereabove by deflection of the movable portion 6. The movable portion 6 in this embodiment is a single member, manufacturing is easy and latitude in the designing is large.

Figure 14B:
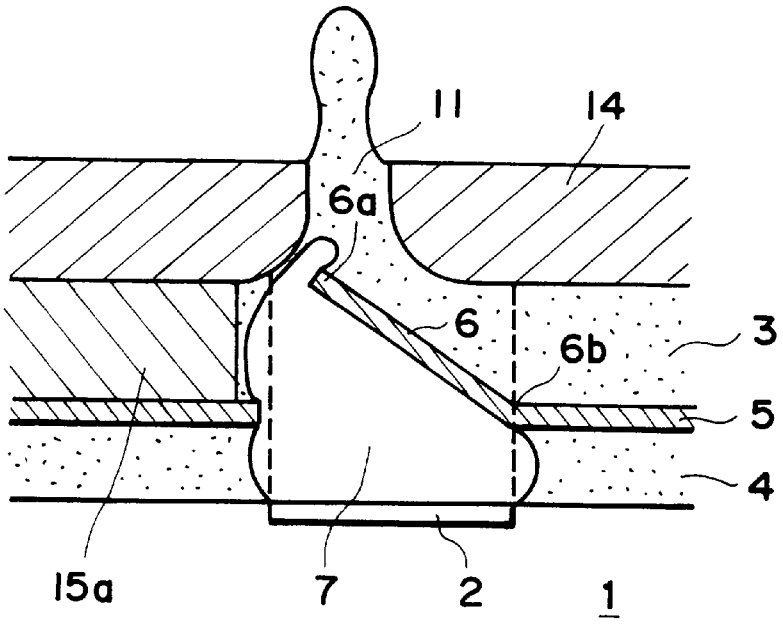
FIG. 14B is a schematic sectional view illustrating liquid ejection state in a liquid ejecting head according to the embodiment of the present invention.

FIG. 14B is a schematic sectional view illustrating the generation, and so on, of the bubble 7 in the liquid ejecting head according to this embodiment. As shown in this Figure, a part of the bubble generated in the region B of the second liquid flow path 4 expands into the first liquid flow path 3 side with the displacement of the movable portion 6 into the first liquid flow path 3 side. Thus, the height of the second liquid flow path 4 (a clearance from the surface of the substrate 1 or the heat generating surface of the heat generating element 2 to the movable portion 6) is such that the bubble extending into the first liquid flow path 3 side, by which the ejection power is further improved. In order to extend the bubble into the first liquid flow path 3, it is desirable the height of the second liquid flow path 4 is made smaller than the height of the maximum bubble, for example, several $\mu$m–30 $\mu$m. In this embodiment, the high ejection power and high ejection efficiency liquid ejecting head can be prevented.

(Embodiment 8)

Figure 15A:
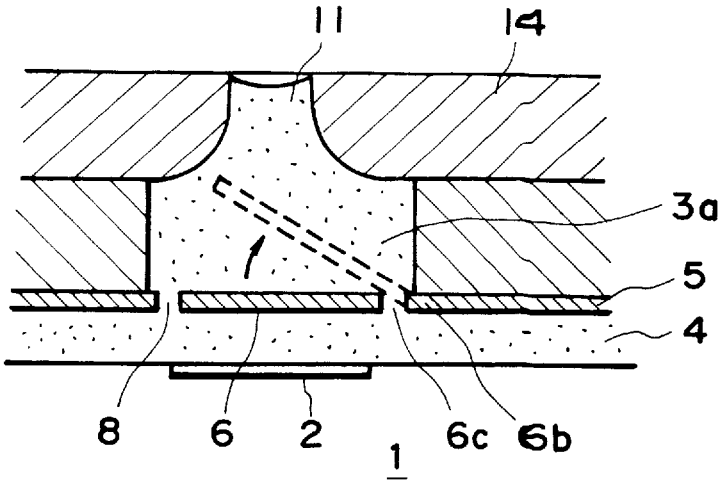
FIG. 15A is a schematic sectional view and a partial schematic top plan view of a liquid ejecting head according to an embodiment of the present invention.
Figure 15B:
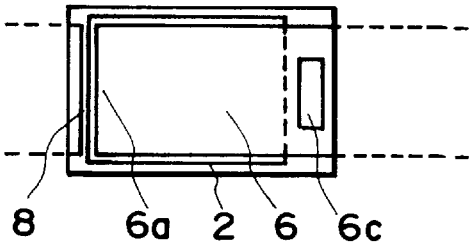
FIG. 15B is a schematic sectional view and a partial schematic top plan view of a liquid ejecting head according to the embodiment of the present invention.

FIG. 15A is a schematic sectional view illustrating major part of a liquid ejecting head according to a further embodiment of the present invention. FIG. 15B is a schematic top plan view of the movable portion of this embodiment, as seen from the ejection outlet side. This embodiment is different from Embodiment 4 in that a pit type liquid passage 4*a* enclosed by walls in four sides is in place of the second liquid flow path 4. In this embodiment, after liquid ejection, the liquid is supplied into the pit type liquid passage 4*a* mainly from the first liquid flow path 3 through the opening 6*c* in the movable member 6. The size of the opening 6*c* will suffice if it permits flow of the ink without escaping the bubble.

In this embodiment the pressure for deflecting up the valve and the pressure of the bubble are both directed toward the ejection outlet. The movable portion 6 returns to the initial position substantially simultaneously with the collapse of bubble, and therefore, the degree of the retraction of the ink meniscus can be minimized, so that the the ink is smoothly supplied to the heat generating surface from the upstream side by the forced refilling function of the ink by the collapse of bubble. By this, a liquid ejecting head with high ejection power and high ejection efficiency, can be prevented.

(Embodiment 9)

Figure 16A:
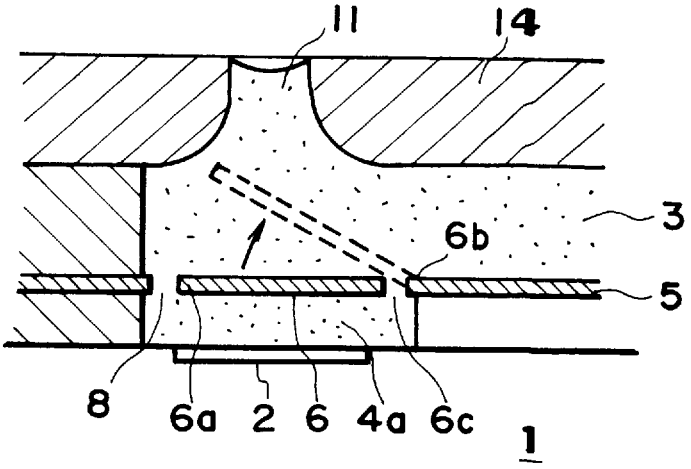
FIG. 16A is a schematic sectional view illustrating a major part of a liquid ejecting head according to an embodiment of the present invention.
Figure 16B:
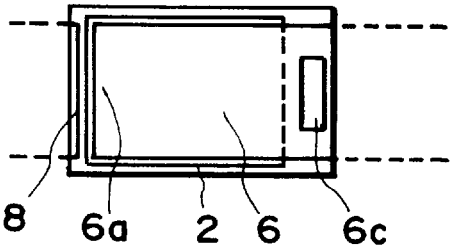
FIG. 16B is a schematic sectional view illustrating a major part of a liquid ejecting head according to the embodiment of the present invention.

FIG. 16A is a FIG. 16A is a schematic sectional view of a major part of a liquid ejecting head according to a further embodiment of the present invention. FIG. 16B is an is a schematic top plan view of a movable portion used in movable portion, as seen from the ejection outlet side. This embodiment is different from Embodiment 7 in that a pit type liquid passage 4*a* enclosed by walls in four sides is in place of the second liquid flow path 4. In this embodiment, after liquid ejection, the liquid is supplied into the pit type liquid passage 4*a* mainly from the first liquid flow path 3 through the opening 6*c* in the movable member 6. The size of the opening 6*c* will suffice if it permits flow of the ink without escaping the bubble.

In this embodiment, the escape of the bubble generation pressure toward the upstream side along the lower part of the movable portion 6, can be suppressed, and therefore, so that the bubble generation pressure can be efficiently directed toward the ejection outlet. Further more, upon the collapse of bubble, the amount of the ink to be refilled is only the one corresponding to the volume of the pit type liquid passage, so that the refilling amount may be small, and the high speed responsivity can be accomplished. According to this embodiment, too, a liquid ejecting head of high ejection power and high ejection efficiency can be prevented.

HEAD EXAMPLE 1

Figure 17:
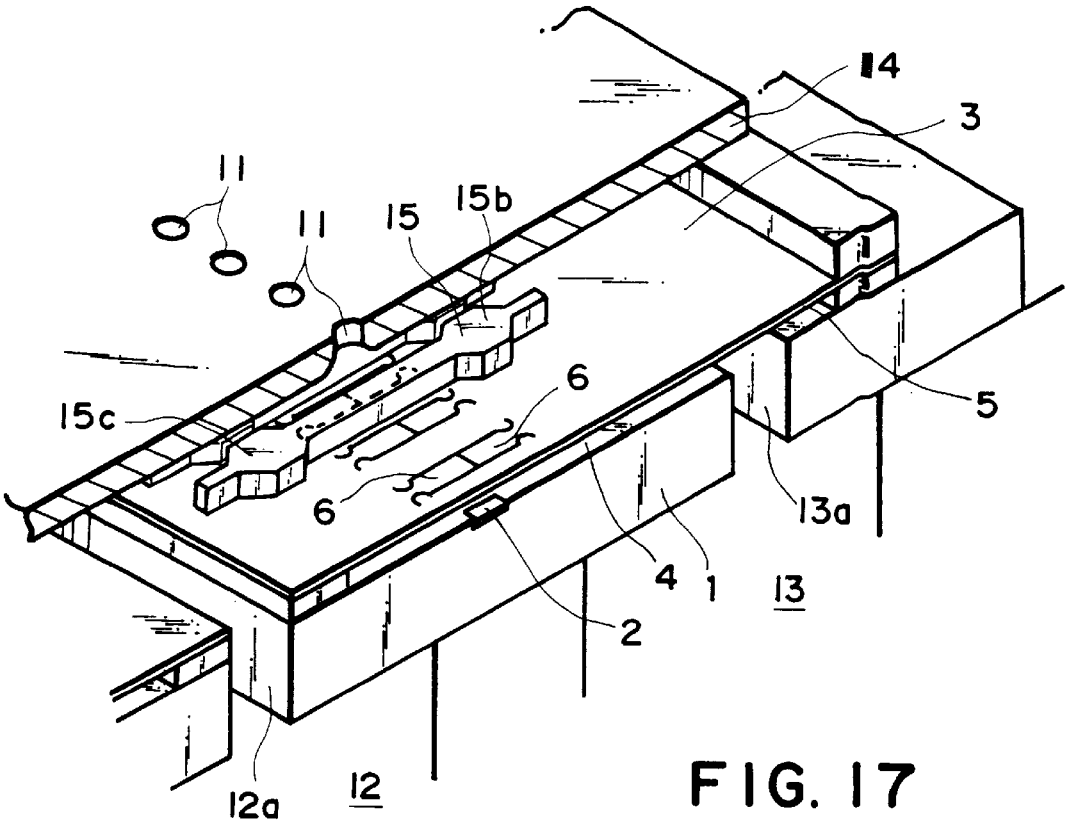
FIG. 17 is partial schematic perspective view of an embodiment of the present invention.

FIG. 17 is a schematic perspective view of an example of a liquid ejecting head according to an embodiment of the present invention, which has a plurality of ejection outlets and a plurality of liquid flow paths in fluid communication therewith, respectively. The liquid ejecting head is formed by a substrate 1, a separation wall 5 and an orifice plate 14 which are laminated with gaps. Substrate 1 has a supporting member of metal such as aluminum and a plurality of heat generating elements 2. Heat generating element 2 is in the form of an electrothermal transducer element generating heat for generating a bubble by film boiling in the bubble generation liquid supplied to the second liquid flow path 4. The substrate 1 is provided with a wiring electrode for supplying the electric signal to the heat generating element 2, and function elements such as transistor, diode, latch, shift register for driving the heat generating elements 2 selectively. On the heat generating element 2, a protection layer (omitted in the Figure) for protecting the heat generating element 2 is provided.

The separation wall 5 is provided with a pair of movable portions 6 so as to oppose to the heat generating element 2. Above the separation wall 5, an orifice plate 14 having ejection outlets 11 is provided with flow passage walls 15 for constituting the first liquid flow paths 3 sandwiched therebetween.

In FIG. 17, reference numeral 12 designates a first common liquid chamber for supplying the ejection liquid through the first supply passage 12*a* to the first liquid flow paths 3. Designated by 13 is second common liquid chamber for supplying the bubble generation liquid through the second supply passage 13*a* to the second liquid flow paths 4. Thus, the first common liquid chamber 12 is in fluid communication with the plurality of first liquid flow paths 3 separated by the flow passage walls 15 on the separation wall 5. The second common liquid chamber 13 is in fluid communication with the plurality of second liquid flow paths 4 separated by the plurality of flow passage walls (omitted in the FIG. for explanation purpose) on the substrate 1.

In the manufacturing of the liquid ejecting head shown in FIG. 17, a dry film having a thickness of 15 $\mu$m (solid photosensitivity resin material) is placed on the substrate 1, and is patterned to form the flow passage walls for constituting the second liquid flow paths 4. The material of the flow passage wall may be any if it exhibits anti-solvent property against the bubble generation liquid, and the flow passage wall can be formed. Examples of such materials include liquid photosensitive resin material in addition to the dry film. Other examples are resin material such as polysulfone or polyethylene or metal such as gold, silicon, nickel, and glass. Thereafter, the substrate 1 and the separation wall 5 are connected to form an integral substrate and separation wall combination while the heat generating element 2 and the movable portion 6 are correctly positioned with each other.

The orifice plate 14 having the ejection outlets 11 are formed from nickel through electro-forming. The orifice plate 14 may be a grooved member having ejection outlets formed by projecting eximer laser to a mold of resin integrally having the first liquid flow path 3. The first liquid flow path 3 is formed by placing a dry film having a thickness of 25 $\mu$m on the back side of the orifice plate 14 and patterning it. Thereafter, the orifice plate 14 is connected with the integral substrate and separation wall combination, while the ejection outlet 11 and the movable portion 6 are correctly positioned relative to each other.

HEAD EXAMPLE 2

Figure 18:
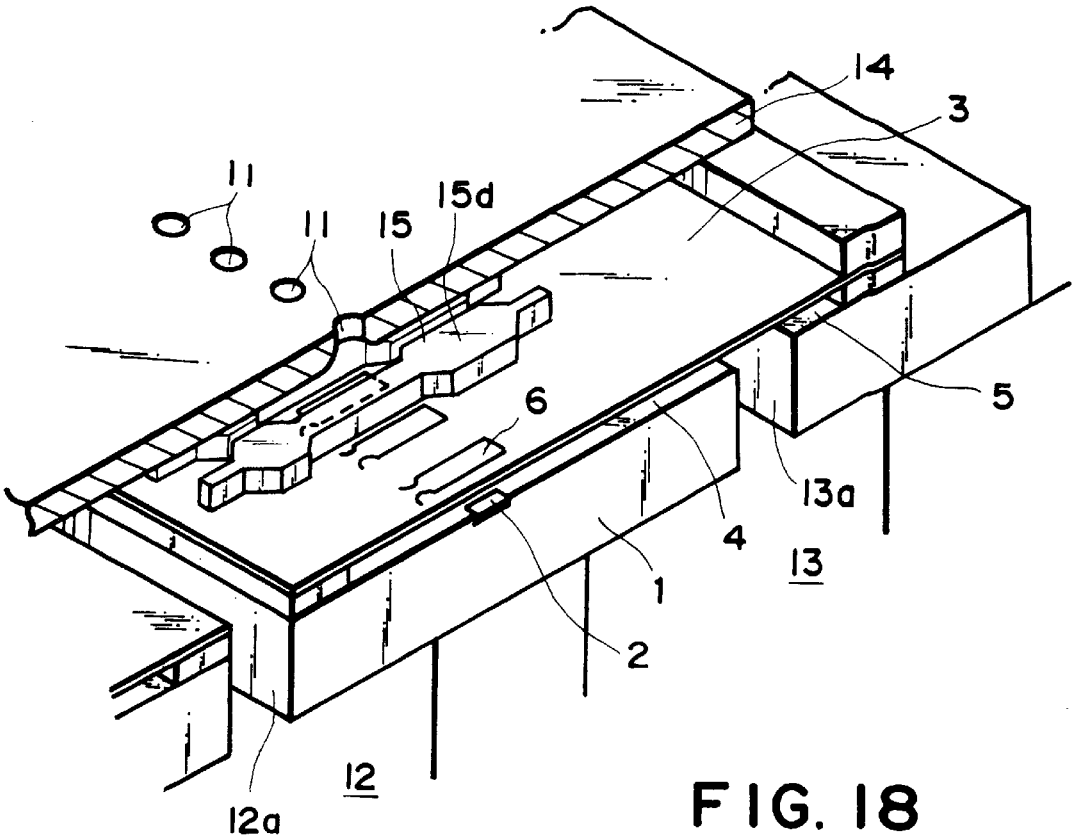
FIG. 18 is an is a partial schematic perspective view of a liquid ejecting head according to an embodiment of the present invention.

FIG. 18 is a schematic perspective view of a liquid ejecting head according to an embodiment of the present invention. The 1 of this embodiment is different from the foregoing head is in that the movable portion 6 is an independent member rather than a pair. The defect 15*d* having the flow passage wall 15 functions as an opposing member. In this embodiment, a liquid ejecting head with the high ejection power and high ejection efficiency, is provided.

(Movable Portion and Separation Wall)

Figure 19A:
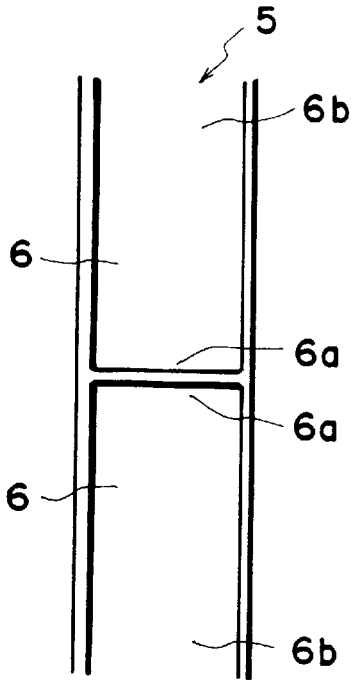
FIG. 19A is a schematic top plan view illustrating an example of a configuration of the movable portion usable in the liquid ejecting head of the present invention.
Figure 19B:
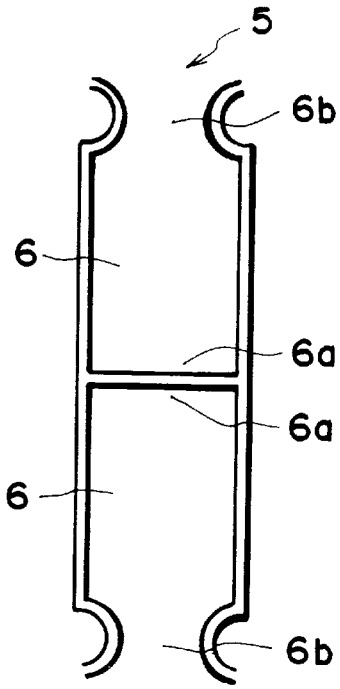
FIG. 19B is a schematic top plan view illustrating another example of a configuration of the movable portion usable in the liquid ejecting head of the present invention.
Figure 19C:
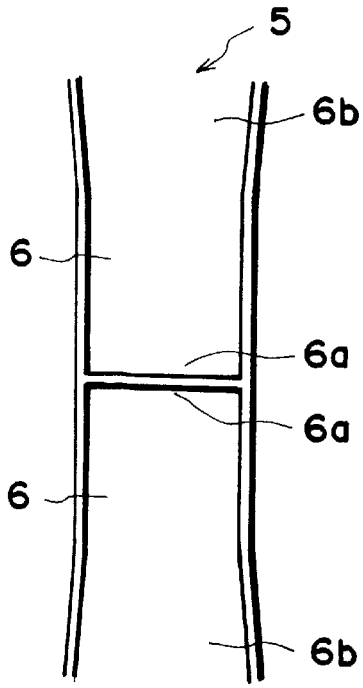
FIG. 19C is a schematic top plan view illustrating a further example of a configuration of the movable portion usable in the liquid ejecting head of the present invention.

FIG. 19A–FIG. 19C are schematic top plan views of liquid ejecting heads having a movable portions according to further embodiments. FIG. 19A shows an example, wherein the movable portion 6 of the separation wall 5 is rectangular. FIG. 19B shows an example, wherein the movable member is rectangular with narrowed base portion 6*b* functioning as the fulcrum upon the displacement or deflection. FIG. 19C shows an example, wherein the movable member is rectangular with wider base portion 6*b* functioning as the fulcrum of the displacement than the free end 6*a* side.

With the use of the movable portion 6 as shown in FIG. 19B, the operation of the displacement is easier. With the movable portion 6 as shown in FIG. 19C, the durability of the movable portion is high. From the standpoint of both of easiness of the operation of the movable portion and the durability of the movable portion, the width of the base portion 6*b* side functioning as the fulcrum, as shown in FIG. 9A, is desirably narrowed arcuately.

Figure 20:
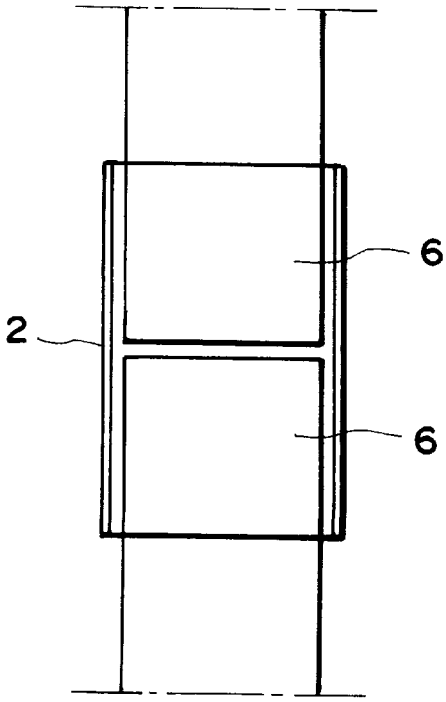
FIG. 20 is a schematic top plan view illustrating example of a movable portion usable with a liquid ejecting head of the present invention.

FIG. 20 is a schematic top plan view of the rectangular movable portion 6 and the heat generating element 2 shown in FIG. 19A, as seen from the ejection outlet side, to show the positional relation therebetween. In order to effectively use the bubble generation pressure, the two movable portions 6 are extended in the different directions so that the portion right above the effective bubble generating region of the heat generating element 2 is covered by the movable portion, that is, the movable ends thereof are opposed to each other. In this embodiment, the movable portions 6 have the same configurations and are arranged symmetrically, but a plurality of movable members having different configurations may be used. The movable portions may be asymmetrical if the durability of the movable portion is high, and the ejection efficiency is high. By making the total area of the movable portion larger than the total area of the heat generating surface of the heat generating element and by positioning the fulcrum of the movable portion outside the region of effective bubble generating region of the heat generating element, the ejection efficiency and the durability of the liquid ejecting head are improved.

In the head having the opposed movable portions as shown in FIG. 7 and the like, it is preferable that the slit is relatively narrow, from the standpoint of the improvement in the ejection efficiency. It is preferable that a line passing through the center of the heat generating surface of the heat generating element and perpendicular to the heat generating surface is close with a line passing through the center of the region of the gap between the free ends and perpendicular to the gap region, and it is further preferable that these lines are substantially overlapped. Further, it is preferable that a line passing through the center of the heat generating surface of the heat generating element and perpendicular to the heat generating surface, passes through the ejection outlet, and it is further preferable that the line and a line perpendicular to the ejection outlet through the center of the ejection outlet are overlapped.

In the head having the one side movable portion as shown in FIG. 14B or the like and the opposing defect thereto, it is preferable that a line passing through the heat generating surface of the heat generating element and perpendicular to the heat generating surface, penetrate the one side movable portion. Additionally, it is preferable that a line passing through the center of the heat generating surface and vertical to the heat generating surface, penetrates the ejection outlet, and it is further preferable that the line and a line passing through the center of the ejection outlet and vertical to the ejection outlet are substantially overlapped.

Figure 21A:
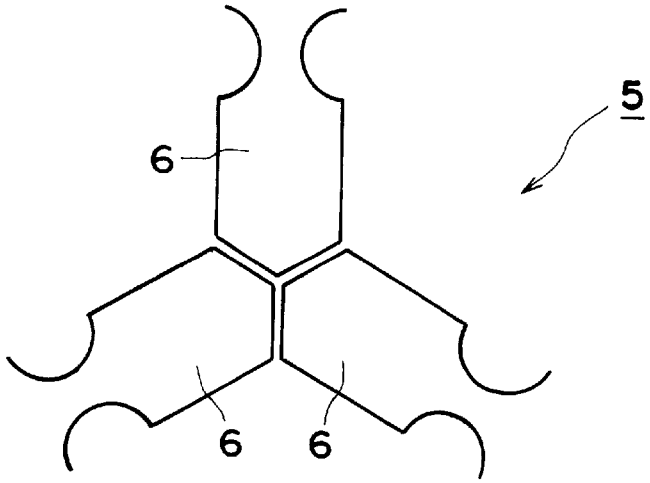
FIG. 21A is a schematic top plan view illustrating an example of a configuration of a movable portion of a liquid ejecting head of the present invention.
Figure 21B:
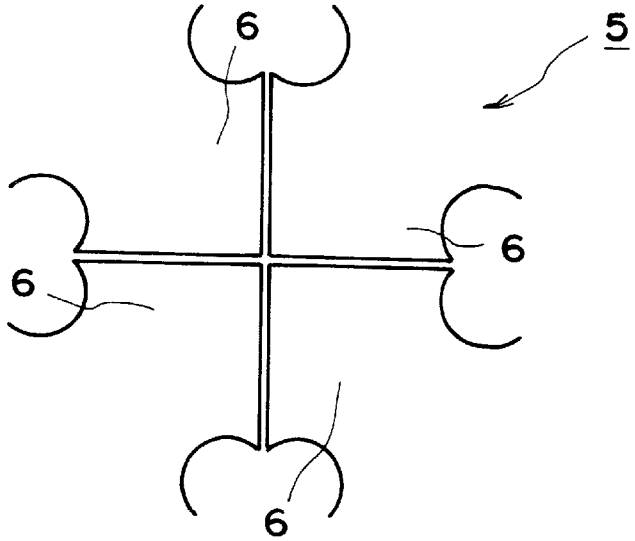
FIG. 21B is a schematic top plan view illustrating another example of a configuration of a movable portion of a liquid ejecting head of the present invention.
Figure 21C:
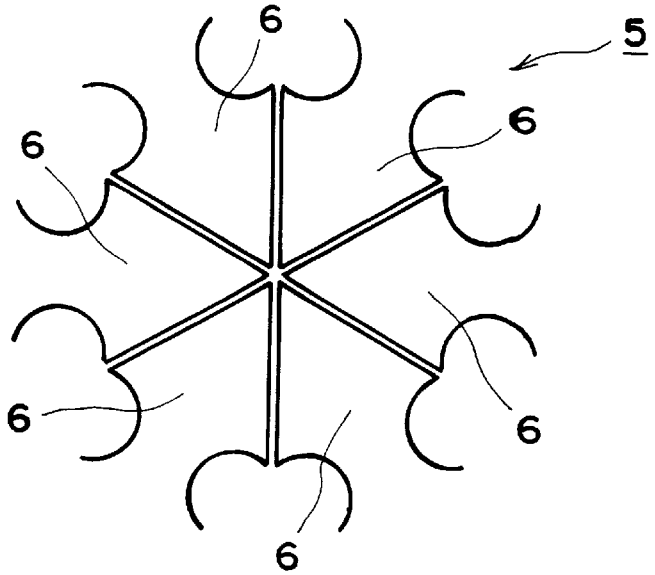
FIG. 21C is a schematic top plan view illustrating a further example of a configuration of a movable portion of a liquid ejecting head of the present invention.

FIG. 21A–FIG. 21C is a schematic top plan view illustrating a configuration in which not less than three movable portions 6 are used for one bubble generation region, and FIG. 21A shows an example of three positions; FIG. 21B shows an example of four positions, and show shows an example of six positions. The number of the movable portions 6 is not limited unless a problem arises in manufacturing. In any cases, the movable portions 6 are arranged in a radial fashion so that the pressure produced by the bubble is applied uniformly to the movable portions 6, and the fulcrum side is made arcuate to accomplish better operation and the durability. By the adjacent radial arrangement of the valve-like movable portion 6, large size droplets can be ejected with high efficiency. The plurality of movable portions 6 can be determined by one skilled in the art in accordance with the diameter of the droplet (dot size) to be ejected.

As for the material of the separation wall including the movable portion, any material is usable if it has anti-solvent property against the bubble generation liquid and the ejection liquid, it has an elasticity suitable for operation as the movable portion, and it is suitable for formation of the fine slit.

Preferable examples of the materials for the movable member include durable materials such as metal such as silver, nickel, gold, iron, titanium, aluminum, platinum, tantalum, stainless steel, phosphor bronze or the like, alloy thereof, or resin material having nitrile group such as acrylonitrile, butadiene, stylene or the like, resin material having amide group such as polyamide or the like, resin material having carboxyl such as polycarbonate or the like, resin material having aldehyde group such as polyacetal or the like, resin material having sulfone group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 $\mu$m–10 $\mu$m approx. is desirable.

As for width of the slit 35 for providing the movable member 31, when the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 $\mu$m approx. slit is enough to avoid the liquid mixture, but not more than 3 $\mu$m is desirable.

In this invention, the movable member has a thickness of $\mu$m order as preferable thickness. When a slit is formed in the movable member having a thickness of $\mu$m order, and the slit has the width (W $\mu$m) of the order of the thickness of the movable member, it is desirable to consider the variations in the manufacturing.

When the thickness of the member opposed to the free end and/or lateral edge of the movable member formed by a slit, is equivalent to the thickness of the movable member, the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%.

Therefore, the present invention covers the case where the mixture ratio of the bubble generation liquid of not more than 20%.

In the foregoing embodiments, the maximum mixture ratio of the bubble generation liquid was 15% even when various viscosities are used. With the bubble generation liquid having the viscosity not more than 5 cps, the mixture ratio was 10% approx. at the maximum, although it is different if the driving frequency is different. The mixed liquid can be reduced by reducing the viscosity of the ejection liquid in the range below 20 cps (for example not more than 5%).

(Ejection Liquid and Bubble Generation Liquid)

When the ejection liquid and the bubble generation liquid are the same liquid, various liquid materials are usable, if it is not deteriorated by the heat imparted by the heat generating element; accumulated material is not easily deposited on the heat generating element; the state change of gassification and the condensation are reversible; and the liquid flow path, movable member or separation wall or the like are not deteriorated. For recording, the liquid used in a conventional bubble jet device as recording liquid, is also usable in this invention.

On the other hand, eve if the ejection liquid and the bubble generation liquid are different liquid materials, the ejection liquid can be ejected by the displacement of the movable portion caused by the pressure produced by the bubble generation of the bubble generation liquid. Therefore, high viscosity liquid such as polyethylene glycol with which the bubble generation is not sufficient upon heat application, and therefore, the ejection power is not sufficient, can be ejected at high ejection efficiency and with high ejection pressure by supplying this liquid in the first liquid flow path and supplying, to the second liquid flow path as the bubble generation liquid, the good bubble generation liquid (a mixed liquid of ethanol and water at 4:6, having a viscosity of 1–2 cps approx., for example).

The liquid easily influenced by heat can be ejected at high ejection efficiency and with high ejection pressure without thermal damage to such liquid, if such liquid is supplied to the first liquid flow path, and the liquid not easily influenced by the heat but having good bubble generation property, is supplied to the second liquid flow path.

Various liquid materials are usable, if it is not deteriorated by the heat imparted by the heat generating element; accumulated material is not easily deposited on the heat generating element; the state change of gassification and the condensation are reversible; and the liquid flow path, movable member or separation wall or the like are not deteriorated. More particularly, examples of such liquids include methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water or the like or a mixture of them.

As for the ejection liquid, various liquid is usable irrespective of thermal property or of the bubble generation property. The liquid having low bubble generation property, the liquid which is easily deteriorated or influenced by heat or the high viscous liquid, which are not easily ejected heretofore, can be ejected. However, it is desirable that the ejection, bubble generation or the operation of the movable portion is not obstructed by the ejection liquid per se or by the reaction with the bubble generation liquid. As for the reaction for the however, bubble generation movable portion of is usable. Other examples of ejection liquid include pharmaceuticals, perfume such as which is easily influenced by heat.

The head shown in FIG. 1 was driven with voltage of 25 V and at 2.5 kHz using:

The bubble generation liquid which was the above-described mixed liquid of ethanol and water;

Ejection liquid which was dye ink (2 cps), pigment ink (15 cps), polyethylene glycol 200 or polyethylene glycol 600.

As a result, satisfactory ejection was confirmed.

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image.

Bubble generation liquid 1:

| | |
|---|---|
| Ethanol | 40 wt. % |
| Water | 60 wt. % |

Bubble generation liquid 2:

| | |
|---|---|
| Water | 100 wt. % |

Bubble generation liquid 3:

| | |
|---|---|
| Isopropyl alcoholic | 10 wt. % |
| Water | 90 wt. % |

Ejection liquid 1:
(Pigment ink approx. 15 cp)

| | |
|---|---|
| Carbon black | 5 wt. % |
| Stylene-acrylate-acrylate ethyl copolymer resin material Dispersion material (oxide 140, weight average molecular weight) | 1 wt. % |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |

Ejection liquid 2 (55 cp):

| | |
|---|---|
| Polyethylene glycol 200 | 100 wt. % |

Ejection liquid 3 (150 cp):

| | |
|---|---|
| Polyethylene glycol 600 | 100 wt. % |

Further, the use was made with the following liquid which is usable both for the ejection liquid and the bubble generation liquid, and the results were that high quality images were recorded because of high ink ejection speed.

Dye ink (viscosity of 2 cps)

| | |
|---|---|
| C.I. hoodblack 2 dye | 3 wt. % |
| Diethylene glycol | 10 wt. % |
| Thiodiglycol | 5 wt. % |
| Ethanol | 3 wt. % |
| Water | 77 wt. % |

In the case of the liquid which is not easily ejected heretofore, the ejection speed is low, and therefore, the variation of the ejecting directions is relatively larger with the result of variations of the shot positions of the droplets and variation of the ejection amounts due to the ejection instability, and therefore, the image quality is not very high. However, according to the embodiment, the generation of the bubble is stable and sufficient. Therefore, the shot accuracy of the liquid droplet is improved, and the ink ejection amount is stabilized, thus remarkably improving the recorded image quality.

(Element Substrate)

Hereinafter, the structure of the element substrate provided with heating members for applying heat to the liquid will be described.

Figure 22A:
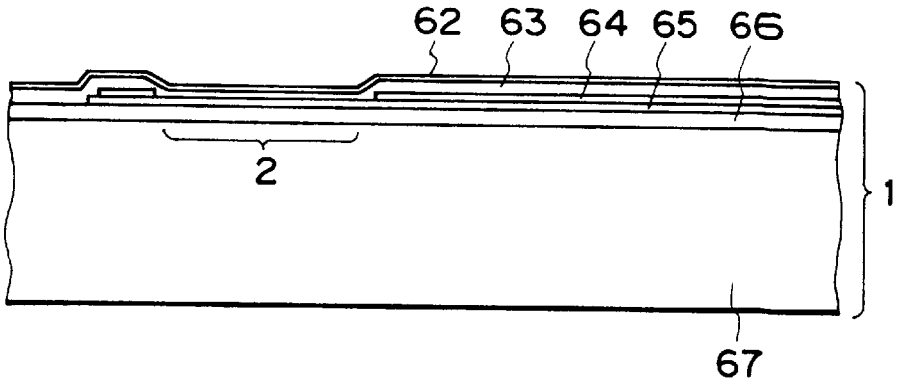
FIG. 22A is a schematic sectional view illustrating an example of a substrate of a liquid ejecting head of the present invention.
Figure 22B:
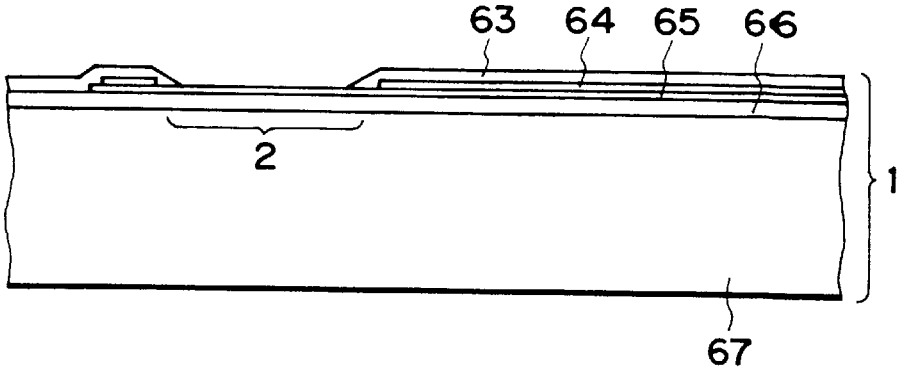
FIG. 22B is a schematic sectional view illustrating an example of a substrate of a liquid ejecting head of the present invention.

FIGS. 22A and 22B are sectional views of the element substrate of the liquid ejection head in accordance with the present invention. FIG. 22A depicts a portion of a head element substrate 1 provided with a protective film, which is on an electrothermal transducer comprising the heating member. FIG. 22B depicts a head element substrate 1 provided with no protective film.

A layer of silicon oxide or silicon nitride is formed as a bottom layer 66 on a substrate 67 of silicon or the like, for the purpose of insulation and heat accumulation. On the bottom layer 66, a 0.01–0.02 $\mu$m thick heat generating resistor layer 65 (heat generating member 2) composed of hafnium boride ($HfB_2$), tantalum nitride (TaN), tantalum aluminum (TaAl), or the like, and a 0.2–1.0 $\mu$m thick patterned wiring electrode 64 of aluminum or the like, are laminated. As voltage is applied to the heat generating resistor layer 65 through these two wiring electrodes 64, a current flows through the heat generating resistor layer 65 located between two electrodes 64, whereby heat is generated.

In the case of the structure depicted in FIG. 22A, the 0.1–2.0 $\mu$m thick protective layer 63 of the silicon oxide, silicon nitride, or the like is formed on the heat generating resistor layer, at least between the wiring electrodes 64. Further, a 0.1–0.6 $\mu$m thick anti-cavitation layer of tantalum or the like is deposited on the protective layer 63, protecting at least the heat generating resistor layer 65 from various liquids such as ink. The reason why metallic material such as tantalum is used as the anti-cavitation layer 62 is that the pressure wave or the shock wave generated during the generation and collapse of the bubble is extremely powerful, being liable to drastically deteriorate the durability of the oxide film which is hard and brittle.

FIG. 22B depicts a heat element substrate 1 without the protective layer 62; the protective layer or the like is not mandatory. As for the heat generating resistor layer material which does not require the protective layer described above, metallic alloy material such as iridium-tantalum-aluminum alloy can be named.

In other words, the structure of the heat generating member in accordance with the present invention may comprise the protective layer which is placed over the heat generating portion of the heat generating resistor layer, between the wiring electrodes, but this not mandatory.

In this embodiment, the heat generating member is constituted of a heat generating resistor layer which generates heat in response to an electric signal. But, the present invention is not limited by this embodiment. The present invention is compatible with any heat generating member as long as it can generate bubbles in the bubble generation liquid sufficiently to eject the ejection liquid. For example, a photothermal transducer which generates heat as it receives light such as a laser beam, or a heating member comprising a heating portion which generates heat as it receives high frequency waves, may be employed.

The element substrate 1 may integrally comprise functional elements such as transistors, diodes, latches, and shift registers, in addition to the aforementioned electrothermal transducers which contain the heat generating resistor layer 65 constituting the heat generating portion, and the wiring electrodes 64 for supplying the electric signals to the heat generating resistor layer 65. These functional elements are also formed through a semiconductor manufacturing process.

Figure 23:
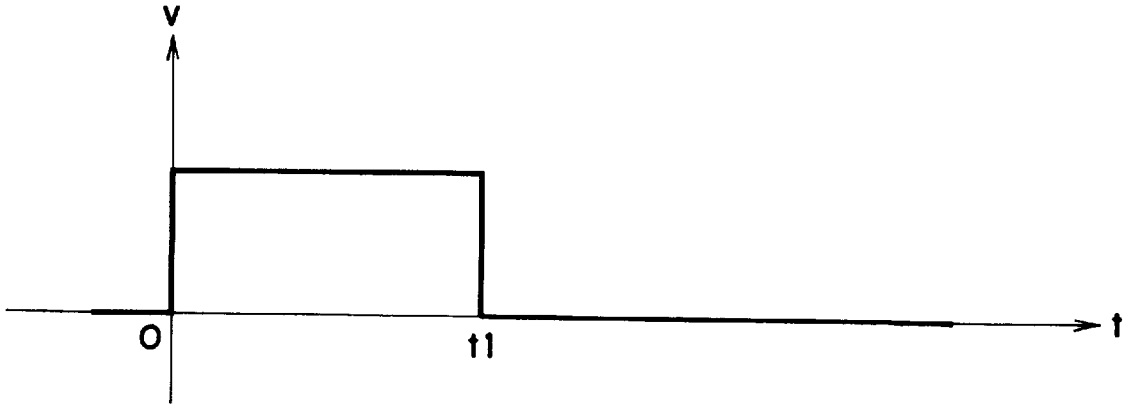
FIG. 23 is a graph showing an example of a driving pulse applied to a liquid ejecting head of the present invention.

FIG. 23 is a graph depicting the pattern of a driving signal applied to the heat generating member. The axis of abscissa presents the duration of the driving signal applied to the heat generating portion, and the axis of ordinates represents the voltage value of the driving signal. In order to eject the liquid by driving the heat generating portion of the electrothermal transducer arranged on the element substrate 1, a rectangular pulse as illustrated in FIG. 23 is applied to the heat generating resistor layer 65 through the wiring electrodes 64, causing the heat generating resistor layer 65 located between the wiring electrodes 64, to rapidly generate heat. In each of the preceding embodiments, the driving signal applied to drive the heat generating member so that the liquid, that is, the ink, could be ejected from the ejection orifice through the aforementioned operation, had a voltage of 24 V, a pulse width of 7 $\mu$sec, a current of 150 mA, and a frequency of 6 kH. However, the specifications of the driving signal are not limited to those described above; any driving signal is acceptable as long as it can properly generate bubbles in the bubble generation liquid.

(Head Production Method) Next, a manufacturing method for the liquid ejection head in accordance with the present invention will be described.

The manufacturing process for the liquid ejection head having the twin liquid flow paths is generally as follows. First, the walls of the second liquid flow path 4 are formed on the element substrate 1, and a separation wall 5 is placed on top of the walls. Then, a grooved member provided with the grooves or the like which will become the first liquid flow path 3 is placed on top of the separation walls 5. The separation wall 5 may be provided on the groove member, and in such a case, after the walls of the second liquid flow path 4 are formed, the grooved member with the separation walls 5 is bonded to the top surfaces of these walls.

Next, the manufacturing method for the second liquid flow path 4 will be described.

FIGS. 24A–24E are schematic sectional drawings depicting the steps of the liquid ejection head manufacturing method in the first embodiment of the present invention.

Figure 24A:
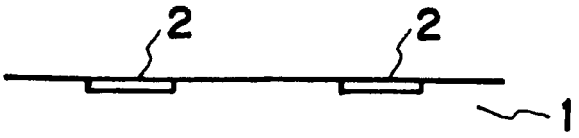
FIG. 24A shows a process step of manufacturing method of a liquid ejecting head according to the present invention.

Referring to FIG. 24A, the electrothermal transducer comprising a heating member 2 composed of hafnium boride, tantalum nitride, and the like is formed on the element substrate 1, that is, an individually plotted section of a silicon wafer, using manufacturing apparatuses similar to those employed for the semiconductor manufacturing process. Then, the surface of the element substrate 1 is cleansed to improve its adhesiveness to the photosensitive resin which is involved in the following step. In order to further improve the adhesiveness, the properties of the element substrate surface are modified with a combination of ultraviolet rays and ozone, or the like combination, and then is spin coated with, for example, a 1 wt. % ethyl alcohol solution of silane coupler A189 (product of NIPPON UNICA).

Figure 24B:
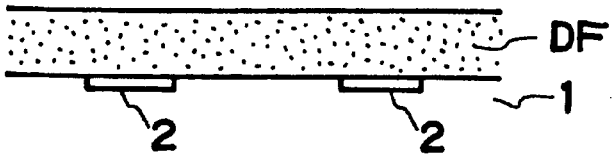
FIG. 24B shows another process step of manufacturing method of a liquid ejecting head according to the present invention.

Next, referring to FIG. 24B, a dry film Odyl SY-318 (product of Tokyo Ohka Kogyo Co., Ltd.), that is, an ultraviolet ray sensitive resin film DF, is laminated on the element substrate 1, the surface of which has been cleansed to improve the adhesiveness.

Figure 24C:
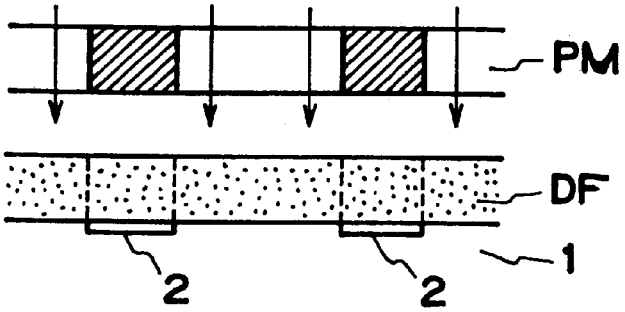
FIG. 24C shows a further process step of manufacturing method of a liquid ejecting head according to the present invention.

Next, referring to FIG. 24C, a photomask PM is placed on the dry film DF. Ultraviolet rays are irradiated on the dry film DF covered with the photomask PM in a predetermined pattern, whereby the regions of the dry film DF, which are not shielded by the photomask PM, are exposed to the ultraviolet rays; these exposed regions are to become the walls of the second liquid flow path. This exposure process is carried out using an MPA-600 (product of Canon Inc.), whereby the rate of exposure is a pproximately 600 mJ/cm$^2$.

Figure 24D:
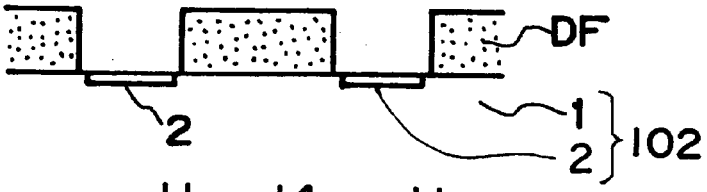
FIG. 24D shows a further process step of manufacturing method of a liquid ejecting head according to the present invention.
Figure 24E:
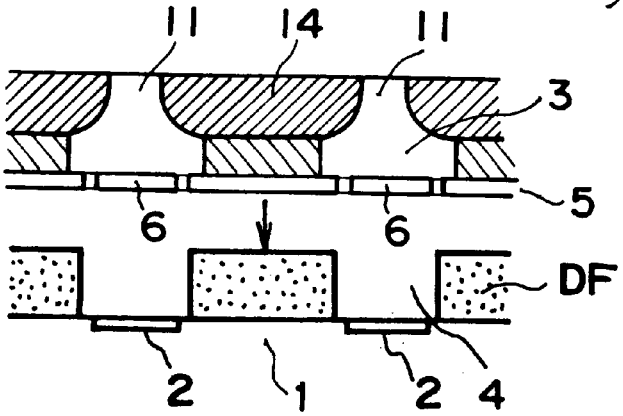
FIG. 24E shows a further process step of manufacturing method of a liquid ejecting head according to the present invention.

Next, referring to FIG. 24D, the dry film DF is developed using a developer BMRC-3 (product of Tokyo Ohka Kogyo Co., Ltd.), which is a mixture of xylene and butyl cellosolve acetate; the unexposed regions are dissolved, leaving the exposed and hardened regions as the walls of the second liquid flow path 4. Then, the residue remaining on the surface of the element substrate 1 is removed by treating the surface of the element substrate 1 for approximately 90 seconds with an oxygen plasma ashing apparatus MAS-800 (product of Alcan-Tech Co., Ltd.). Next, the exposed regions are further irradiated with ultraviolet rays with a strength of 100 mJ/cm$^2$ for two hours at a temperature of 150° C., being completely hardened.

According to the above method, the second liquid flow path is uniformly and precisely formed on each of the heater boards on the silicon substrate.

Next, a gold stud bump is formed on the electrical joint of the heater board using a bump bonder (product of Kushu Matsushita Electric Co., Ltd.). Thereafter, the silicon wafer is cut using a dicing machine AWD-4000 (product of Tokyo Seimitsu) equipped with a 0.05 mm thick diamond blade, separating each heater board 1. Next, a TAB tape and the heater board 1 are joined. Next, a compound member formed by bonding the grooved member 14*a* and the separation wall 5 is precisely positioned on the heater board 1 and bonded thereto.

When the above method is used, not only can the liquid flow path be precisely formed, but it also can be positioned without becoming misaligned relative to the heater of the heater board. Since the grooved member 14*a* and the separation wall 5 are bonded together in a preceding step, the accuracy in the positional relationship between the first liquid flow path 3 and the flexible member 6 can be improved. The employment of these high precision manufacturing technologies makes it possible to produce a liquid ejection head capable of stable ejection, essential to the improvement of print quality. Further, these technologies allow a large number of heads to be formed on the wafer at the same time, making it possible to manufacture a large number of heads at low cost.

In this embodiment, a dry film which can be hardened with ultraviolet rays was used to form the second liquid flow path 2, but a resin material, the absorption band of which is in the ultraviolet ray spectrum, in particular, near 248 nm, may be employed. In the latter case, the resin is hardened after being laminated, and then, the second liquid flow path is formed by directly removing the portions, which are to become the second liquid flow path, from the hardened resin using an excimer laser.

FIGS. 25A–25E are schematic sectional drawings depicting the steps of the manufacturing method for the grooved member of the liquid ejection head in accordance with the present invention.

Figure 25A:
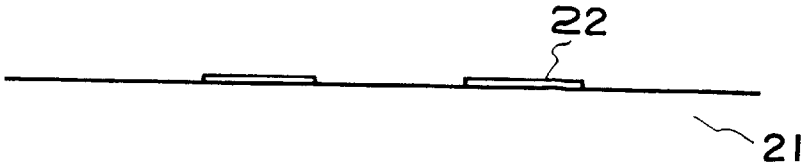
FIG. 25A schematically shows a process step for manufacturing a grooved member usable with a liquid ejecting head of the present invention.

Referring to FIG. 25A, in this embodiment, a 0.5 $\mu$m thick resist 22 is placed on a stainless steel (SUS) substrate 21, in a predetermined pattern having the same pitch as the ejection orifice. In this embodiment, a resist having a diameter of 59 $\mu$m is formed to yield an ejection orifice having a diameter of 30 $\mu$m.

Figure 25B:
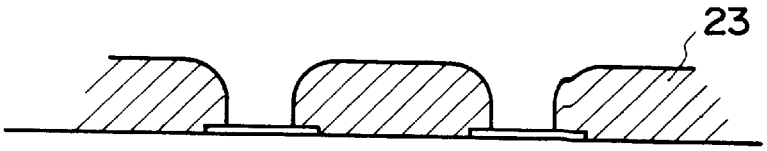
FIG. 25B schematically shows a process step for manufacturing a grooved member usable with a liquid ejecting head of the present invention.

Next, referring to FIG. 25B, a nickel layer 23 is grown on the SUS substrate 21 to a thickness of 15 $\mu$m by electroplating. As for the plating solution, a mixture of sulfamic acid nickel, stress reducing agent Zero Ohru (product of World Metal Inc.), boric acid, anti-pitting agent NP-APS (product of World Metal Inc.), and nickel chloride, is used. As for the means for applying an electric field, an electrode is attached to the anode side, and the SUS substrate 21 on which pattering has been completed is attached to the cathode side. The temperature of the plating solution and the current density are kept at 50° C. and 5 A/cm$^2$, respectively. Thus, not only is the nickel layer allowed to grow in the thickness direction of the resist, but also in the diameter direction of the resist pattern, at the same speed. As a result, a preferable diameter is realized for the ejection orifice.

Figure 25C:
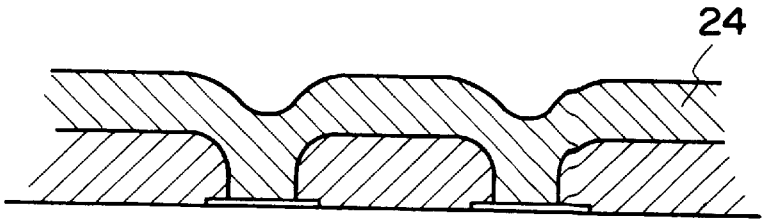
FIG. 25C schematically shows a process step for manufacturing a grooved member usable with a liquid ejecting head of the present invention.

Next, referring to FIG. 25C, a Dry Film Ordyl SY-318 (product of Tokyo Ohka Kogyo Co., Ltd.), that is, an ultraviolet sensitive resin film 24, is laminated on the nickel plated substrate 21.

Figure 25D:
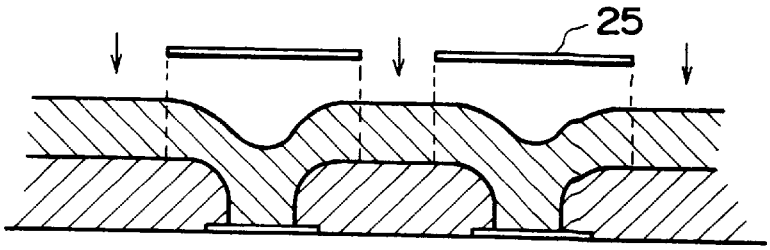
FIG. 25D schematically shows a process step for m manufacturing a grooved member usable with a liquid ejecting head of the present invention.

Then, referring to FIG. 25D, a photomask 25 is placed on the dry film 24, and the dry film 24 shielded with the photomask 25 in the predetermined pattern is irradiated with ultraviolet rays; the regions which will be left as the liquid path walls are irradiated with ultraviolet rays. This exposure process is carried out using an exposing apparatus MPA-600 (product of Canon Inc.), wherein the rate of the exposure is approximately 600 mJ/cm$^2$.

Figure 25E:
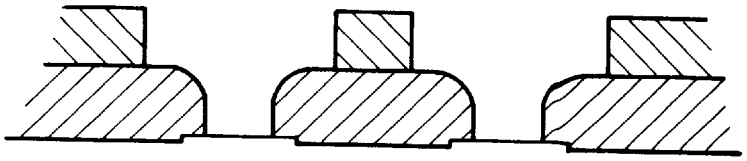
FIG. 25E schematically shows a process step for manufacturing a grooved member usable with a liquid ejecting head of the present invention.

Next, referring to FIG. 25E, the dry film 24 is developed using a developer BMRC-3 (product of Tokyo Ohka Kogyo Co., Ltd.), which is a mixture of xylene and butyl cellosolve acetate; the unexposed regions are dissolved, leaving the regions hardened by the exposure as the walls of the liquid flow paths. The residue remaining on the surface of the substrate is removed by treating the surface of the substrate for approximately 90 seconds with an oxygen plasma ashing apparatus MAS-800 (product of Alcan-Tech Co., Ltd.). Next, the exposed regions are further irradiated with ultraviolet rays with a strength of 100 mJ/cm$^2$ for two hours at a temperature of 150° C., being completely hardened. Thus, 15 $\mu$m high walls are formed. Next, the nickel layer 24 is separated from the SUS substrate 21 by applying ultrasonic vibrations to the SUS substrate 21, yielding a grooved member in the predetermined form.

In this embodiment, the liquid flow path was formed of resin material, but the grooved member may be formed of nickel alone. In the latter case, the regions of the dry film 24, which are not to become the liquid path walls, are removed in the step illustrated in FIG. 25D, and a nickel layer is accumulated by plating on the surface created by the removal of the "non wall" regions. Then, the resist is removed. When the surface of the nickel layer portion of the grooved member is placed with gold, the grooved member will be provided with much better solvent resistance.

FIGS. 26A–26D are schematic sectional drawings depicting the steps of the liquid ejection head manufacturing method in the second embodiment of the present invention.

Figure 26A:
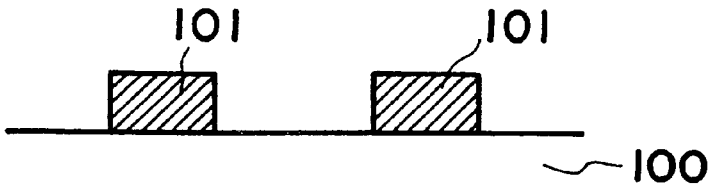
FIG. 26A shows a process step of another embodiment of a manufacturing method of a liquid ejecting head of the present invention.

Referring to FIG. 26A, in this embodiment, a 15 $\mu$m thick resist 101 is placed on a stainless steel (SUS) substrate 100, in the pattern of the second liquid flow path.

Figure 26B:
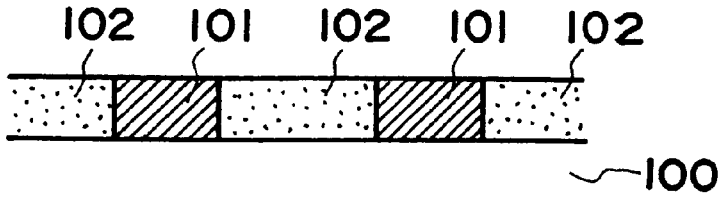
FIG. 26B shows a process step of the embodiment of a manufacturing method of a liquid ejecting head of the present invention.

Next, referring to FIG. 26B, a nickel layer is grown on the exposed surface of the SUS substrate 100 by plating, to a thickness of 15 $\mu$m. the same thickness as the thickness of the resist 101. As for the plating solution, a mixture of sulfamic acid nickel, stress reducing agent Zero Ohru (product of World Metal Inc.), boric acid, anti-pitting agent NP APS (product of World Metal Inc.), and nickel chloride, is used. As for the means for applying an electric field, an electrode is attached to the anode side, and the SUS substrate 21 on which pattering has been completed is attached to the cathode side. The temperature of the plating solution and the current density are kept at 50° C. and 5 A/cm$^2$, respectively.

Figure 26C:
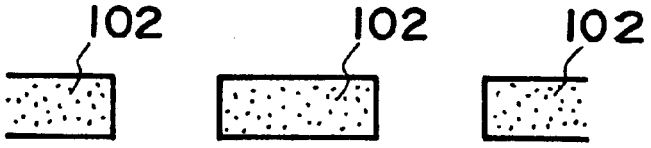
FIG. 26C shows a process step of the embodiment of a manufacturing method of a liquid ejecting head of the present invention.
Figure 26D:
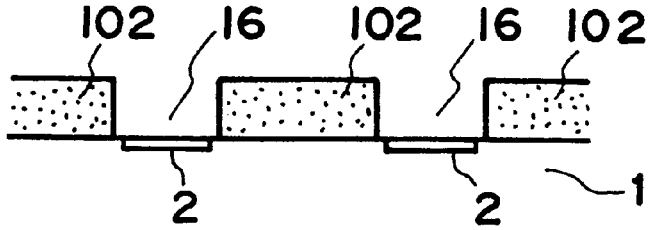
FIG. 26D shows a process step of the embodiment of a manufacturing method of a liquid ejecting head of the present invention.

Next, referring to FIG. 26C, after the above described plating process is completed, the nickel layer 102 portion is separated from the SUS substrate by applying ultrasonic vibrations to the SUS substrate, completing the second liquid flow path with predetermined specifications. When the surface of the nickel layer portion is plated with gold after the nickel layer portion 102 is separated, the second liquid flow path will be provided with higher solvent resistance.

In the meantime, the heater boards comprising electrothermal transducers are formed on a silicon wafer using a manufacturing apparatus similar to a semiconductor manufacturing apparatus. The wafer on which the heater boards have been formed is cut with a dicing machine, separating individual heater boards as described above. The separated heater board 1 is bonded to a TAB tape to provide electrical wiring. Next, referring to FIG. 26D, the above described member comprising the second liquid flow path is precisely positioned on the heater board 1 which has been prepared as described above, and fixed thereto. During this positioning and fixing step, the strength with which the member comprising the second liquid flow path is fixed to the heater board 1 only has to be enough to prevent them from displacing from each other when the top plate is bonded thereon. This is because during the later steps, the top plate on which the separation walls have been fixed is placed on the thus assembled heater board, and all components are firmly fixed together using a pressing spring.

In this embodiment, an ultraviolet ray hardening type adhesive (product of GRACE JAPAN; Amicon UV-300) is coated to the joint and is hardened with an ultraviolet radiation apparatus. The rate of exposure is 100 mJ/cm$^2$, and the duration of exposure is approximately three seconds.

According to the manufacturing method described in this embodiment, not only can the second liquid flow path be highly precisely produced, but also can be positioned without becoming misaligned relative to the heat generating member. In addition, the liquid flow path wall is formed of nickel. Therefore, it is possible to provide a highly reliable and highly alkali resistant head.

FIGS. 27A–27D are schematic sectional drawings depicting the steps of the liquid ejection head manufacturing method in the third embodiment of the present invention.

Figure 27A:
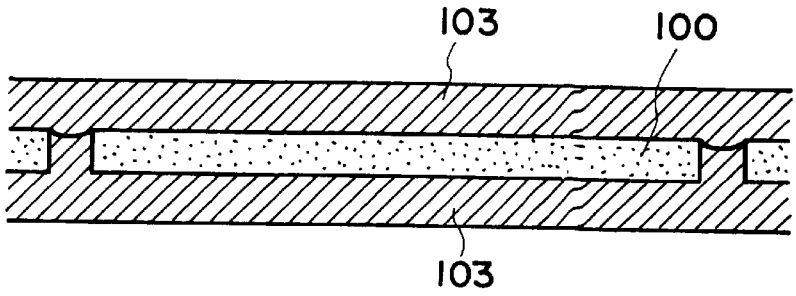
FIG. 27A shows a process step of another embodiment of a manufacturing method of a liquid ejecting head of the present invention.

Referring to FIG. 27A, a resist 103 is coated on both surfaces of a 15 $\mu$m thick stainless steel (SUS) substrate 100 provided with alignment holes or marks 104. As for the resist, PMERP-AR900, a product of Tokyo Ohka Kogyo Co., Ltd., is used.

Figure 27B:
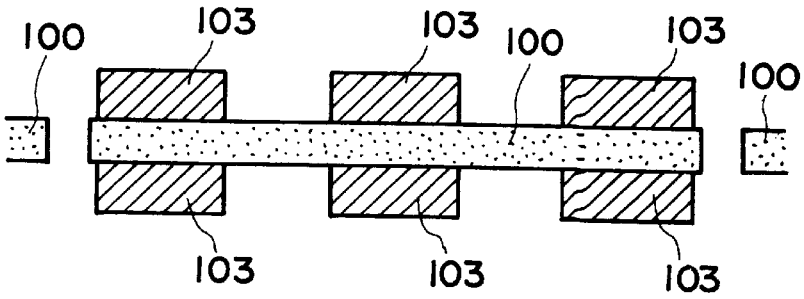
FIG. 27B shows a process step of the embodiment of a manufacturing method of a liquid ejecting head of the present invention.

Next, referring to FIG. 27B, the resist coated substrate 100 is exposed using an exposure apparatus MPA-600 (product of Canon Inc.), and then, the resist 103 is removed from the regions correspondent to the second liquid flow paths and the alignment holes 104. The rate of exposure is 800 mJ/cm$^2$.

Figure 27C:
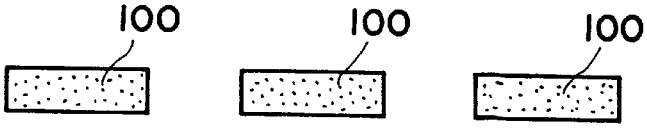
FIG. 27C shows a process step of the embodiment of a manufacturing method of a liquid ejecting head of the present invention.

Next, referring to FIG. 27C, the SUS substrate 100 having a patterned resist 103 on both surfaces is immersed in an etching liquid (water solution of ferric chloride or cupric chloride), etching away the portions not covered by the resist 103, and then, the resist is removed.

Figure 27D:
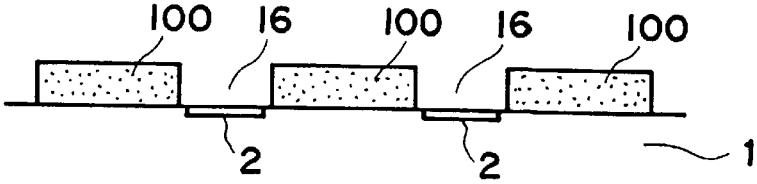
FIG. 27D shows a process step of the embodiment of a manufacturing method of a liquid ejecting head of the present invention.

Next, referring to FIG. 27D, the etched SUS substrate 100 is positioned on the heater board 1, and is fixed thereto, completing a liquid ejection head comprising the second liquid flow path 4, in the same manner as the manufacturing method described in the preceding embodiment.

According to this embodiment, not only can the second liquid flow path be formed with high precision but also can be positioned without becoming misaligned relative to the heater. In addition, the liquid flow path is formed of stainless steel. Therefore, it is possible to provide a highly reliable as well as highly alkali resistant liquid ejection head.

According to the head manufacturing method described above, the walls of the second liquid flow path are formed on the element substrate in advance, making it possible to accurately position the electrothermal transducer and the second liquid flow path relative to each other. Further, the second liquid flow path can be formed on a large number of the element substrates collectively plotted on the substrate wafer before the substrate wafer is diced into separate pieces of element substrates. Therefore, a large number of liquid ejection heads can be provide at low cost.

Further, in the liquid ejection head manufactured by the manufacturing method described in this embodiment, the heat generating member and the second liquid flow path are positioned relative to each other with high precision; therefore, the pressure from the bubble generation caused by the heat generation of the electrothermal transducer is effectively transmitted, making the head superior in ejection efficiency.

(Liquid Ejection Head Cartridge)

Next, a liquid ejection head cartridge in which the liquid ejection head in accordance with the preciding embodiments is mounted, will be concisely described.

Figure 28:
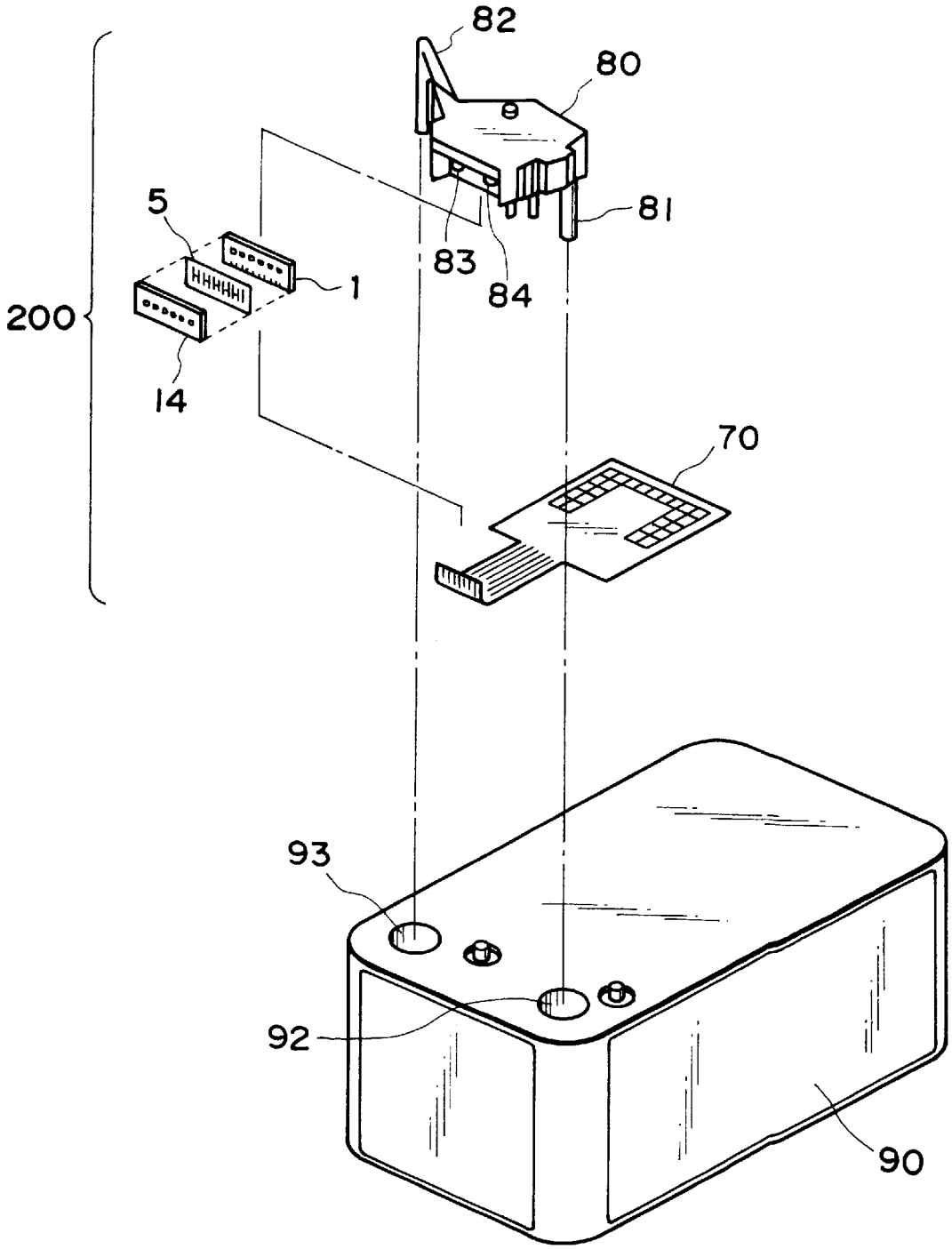
FIG. 28 is an exploded perspective view of a liquid ejection head cartridge according to another embodiment of the present invention.

FIG. 28 is an exploded schematic view of the liquid ejection head cartridge comprising the aforementioned liquid ejection head. Essentially, the liquid ejection head cartridge comprises a liquid ejection head portion 200 and a liquid container 80.

The liquid ejection head portion 200 comprises an element substrate 1, a separation wall 30, a grooved member 50, a liquid container 90, a circuit board (TAB tape) 70 for supplying an electric signal, and the like. On the element substrate 1, a number of heat generating resistors for applying heat to the bubble generation liquid are aligned. Also on the element substrate 1, a number of functional elements for selectively driving these heat generating resistors are provided. A liquid flow path is formed between the element substrate 1 and the separation wall 30 comprising the flexible member, and the bubble generation liquid flows through this liquid flow path. The ejection liquid path (unillustrated), that is, the liquid path through which the liquid to be ejected flows, is formed as the separation wall 30, the grooved member 50, and the liquid delivery member 80 are joined. Both liquids are supplied through the liquid delivery member 80, being routed behind the substrate 1.

The liquid container 90 separately contains the liquid such as ink, and the bubble generation liquid for generating bubbles, both of which are delivered to the liquid ejection head. On the exterior surface of the liquid container 90, a positioning member 94 is provided for locating a connecting member which connects the liquid ejection head and the liquid container. The TAB tape 70, which is attached after the head portion is positioned on the liquid container 90, is fixed to the surface of the liquid container 90 using a double face adhesive tape. The ejection liquid is delivered to the first common liquid chamber by way of the ejection liquid delivery path 92 of the liquid container, the delivery path 84 of the connecting member, and the ejection liquid delivery path of the liquid delivery member 80, in this order. The bubble generation liquid is delivered to the second common liquid chamber by way of the delivery path 93 of the liquid container, the supply path of the connecting member, and the bubble generation liquid path 82 of the liquid delivery member 80, in this order.

In the foregoing, the description was given with reference to a combination of the liquid ejection head cartridge and the liquid container, which is capable of separately delivering or containing the bubble generation liquid and the ejection liquid when the bubble generation liquid and the ejection liquid are different. However, when the ejection liquid and the bubble generation liquid are the same, it is unnecessary to provide separate delivery paths and containers for the bubble generation liquid and the ejection liquid.

Incidentally, the liquid container described above may be refilled after each liquid is consumed. In order to do so, it is preferable that the liquid container is provided with a liquid filling port. Further, the liquid ejection head and the liquid container may be inseparable or separable.

Figure 29:
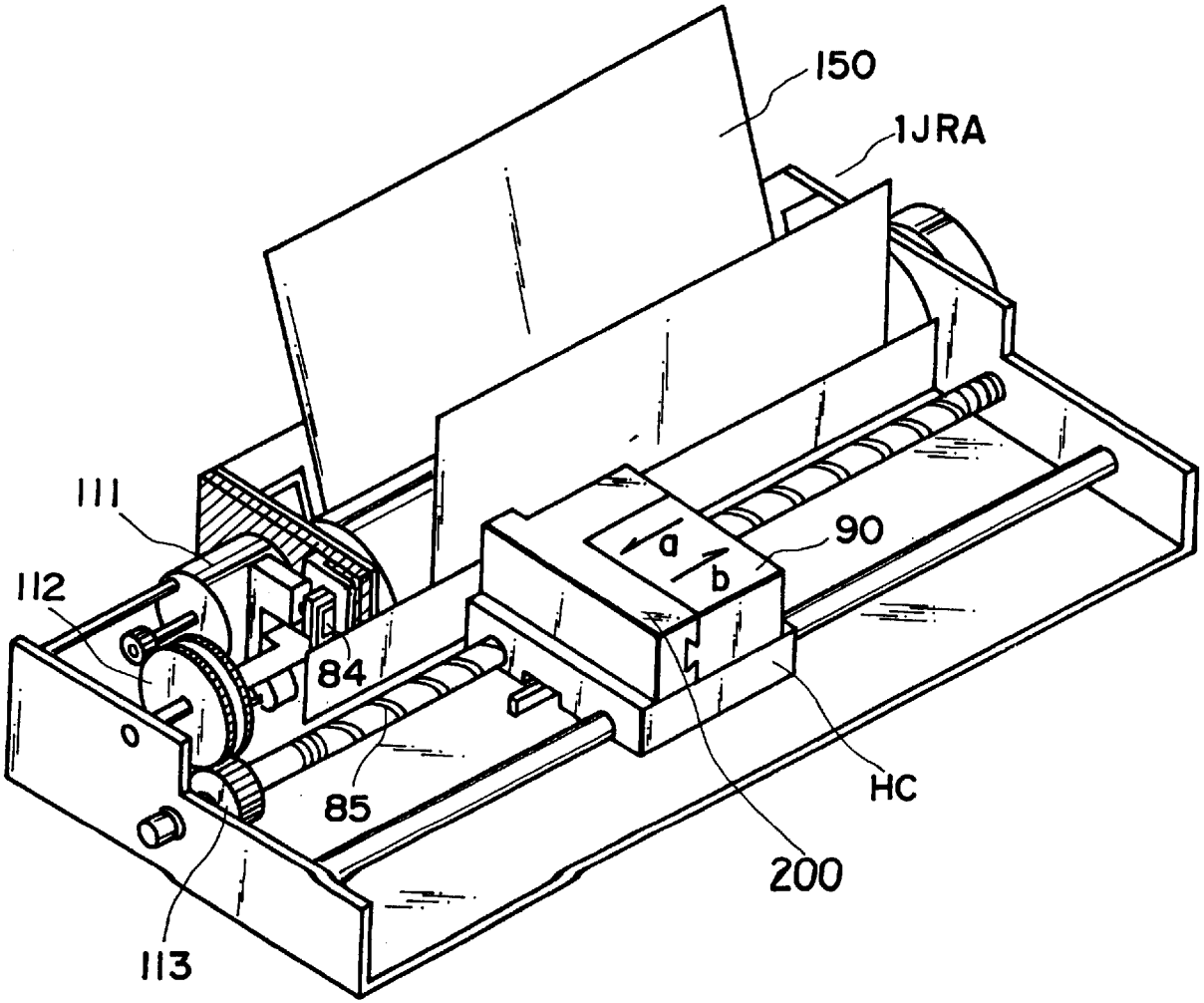
FIG. 29 is a schematic perspective view of a liquid ejecting device according to another embodiment of the present invention.

FIG. 29 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 30:
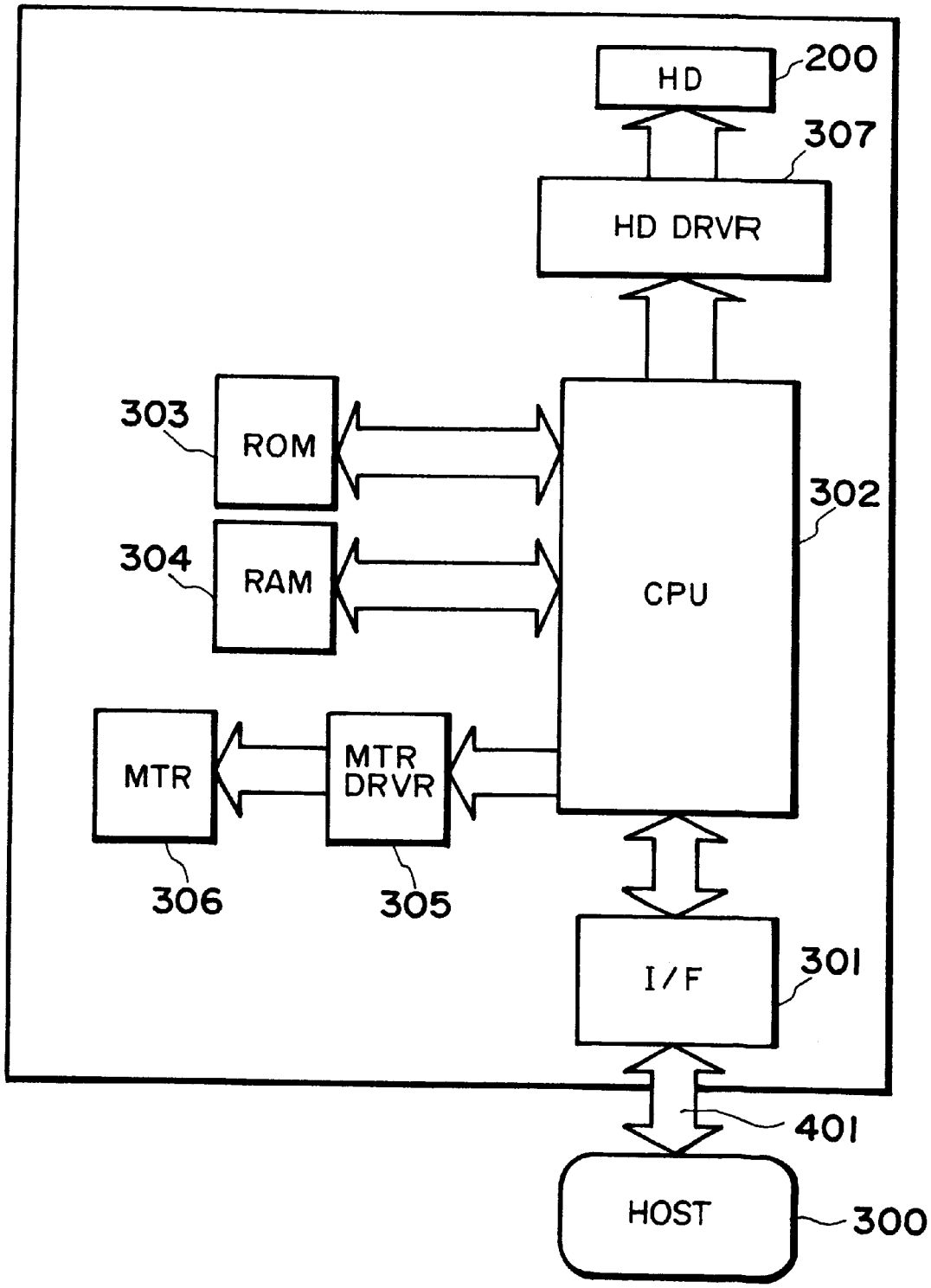
FIG. 30 is a block diagram of an example liquid ejecting device.

FIG. 30 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed; various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

(Recording System)

Next, an exemplary ink jet recording system will be described, which records images on recording medium, using, as the recording head, the liquid ejection head in accordance with the present invention.

Figure 31:
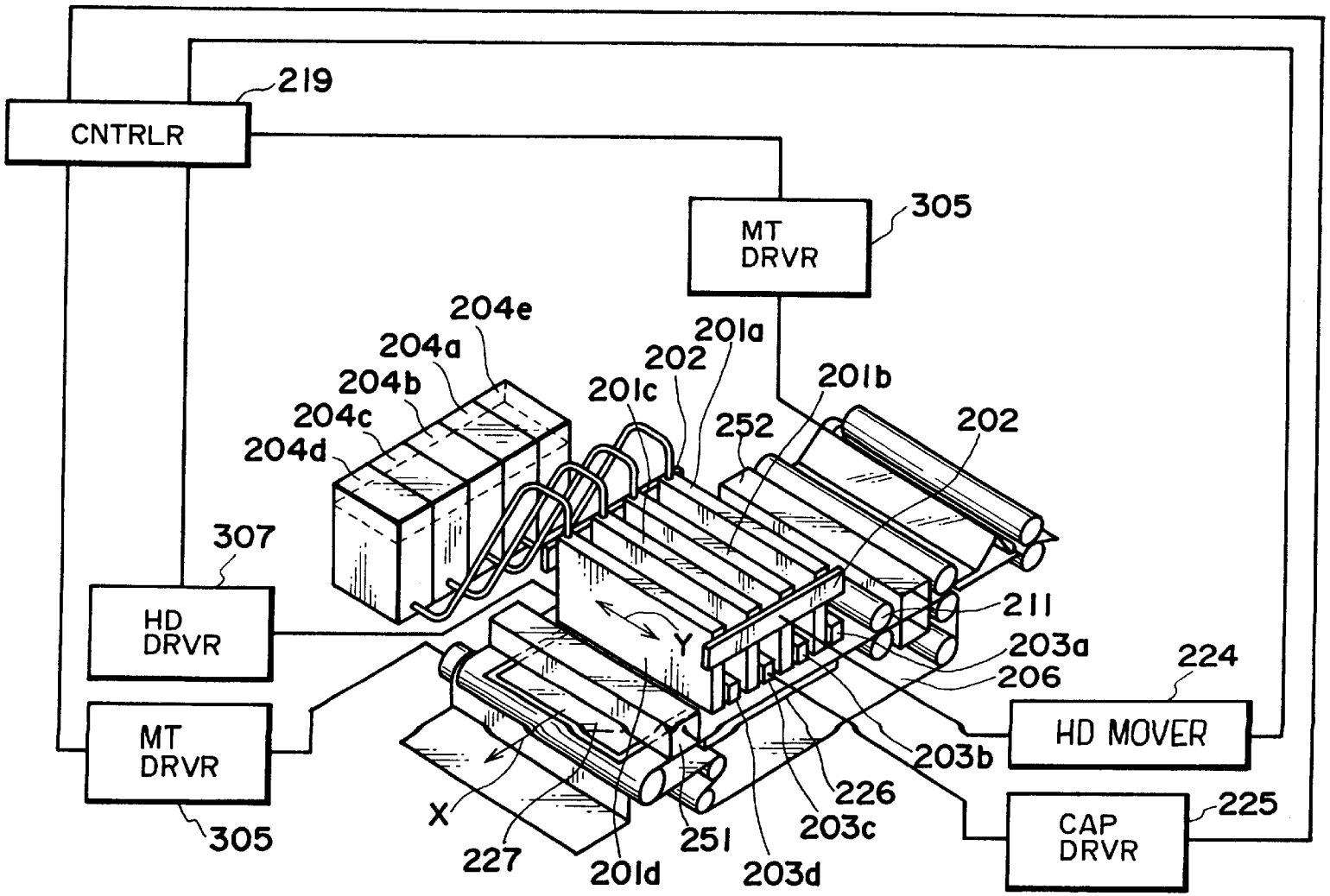
FIG. 31 is a perspective view of example of a liquid ejection recording system.

FIG. 31 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity, the dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

(Head Kit)

Figure 32:
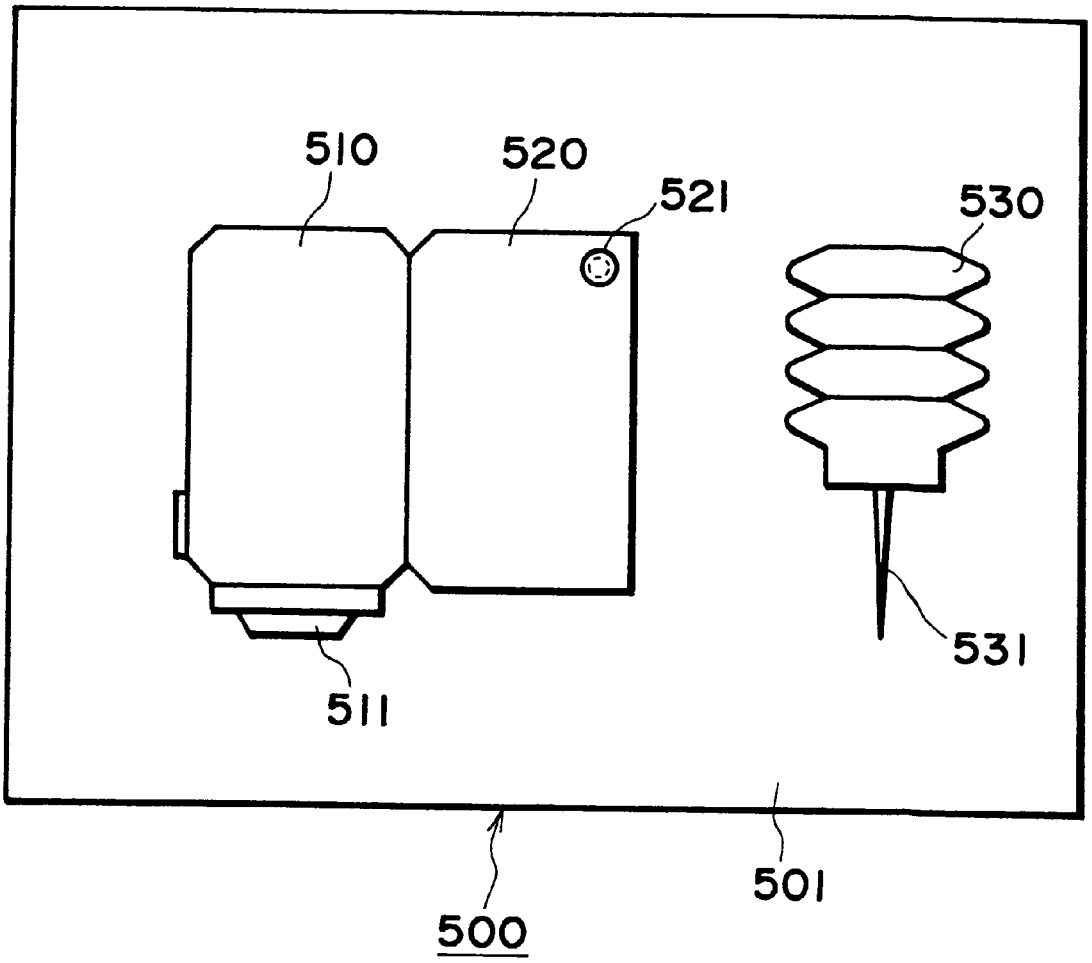
FIG. 32 is a schematic view of an example of a liquid ejecting head kit.

Hereinafter, a head kit will be described, which comprises the liquid ejection head in accordance with the present invention. FIG. 32 is a schematic view of such a head kit. This head kit is in the form of a head kit package 501, and contains: a head 510 in accordance with the present invention, which comprises an ink ejection section 511 for ejecting ink; an ink container 510, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 32 illustrates only the ink filling means for filling the printing ink into the ink container, the head kit may contain means for filling the bubble generation liquid into the bubble generation liquid container, in addition to the printing ink refilling means.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection head comprising:

a substrate having a heat generating surface for generating heat for generating a bubble in a liquid;

a movable member having a free end and a fulcrum, the free end being disposed downstream of the fulcrum, the movable member and the heat generating surface having a space therebetween;

an ejection outlet for ejecting the liquid using the generation of the bubble, the ejection outlet being opposed to the substrate with said movable member interposed therebetween;

an opposing member cooperable with the movable member to direct the bubble toward the ejection outlet, wherein said opposing member opposes to such a side of the movable member as is near to the heat generating surface when the free end of the movable member is displaced by the bubble; and a fluid flow path through which, as the bubble collapses, the fluid flows downstream and at least partway beneath said movable member into the space, wherein the movable member directs the growing bubble toward the ejection outlet in a direction substantially perpendicular to the heat generating surface.

2. An ejection head according to claim 1, wherein a member defining the ejection outlet and the heat generation surface are substantially parallel with each other.

3. An ejection head according to claim 1, wherein the opposing member is a second movable member having a free end, and the free ends of the movable members are opposed to each other with a gap therebetween.

4. An ejection head according to claim 3, wherein a first line perpendicular to the heat generating surface and passing through a center of the heat generating surface, and a second line perpendicular to the gap and passing through a center of the gap, are close to each other.

5. An ejection head according to claim 4, wherein said lines are substantially overlapped with each other.

6. An ejection head according to claim 3, wherein said first line penetrates the ejection outlet.

7. An ejection head according to claim 6, wherein said first line and a line perpendicular to the ejection outlet and passing through a center of the ejection outlet are substantially overlapped with each other.

8. An ejection head according to claim 1, wherein the opposing member is a wall.

9. An ejection head according to claim 8, wherein said first line penetrates the movable member.

10. An ejection head according to claim 8, wherein said first line penetrates the ejection outlet.

11. An ejection head according to claim 10, wherein said first line and a line perpendicular to the ejection outlet and passing through a center of the ejection outlet, are substantially overlapped.

12. An ejection head according to claim 1, wherein liquid flow paths are formed at one side of said movable member and at the other side of said movable member, respectively.

13. An ejection head according to claim 12, wherein the movable member is a part of a separation wall between the liquid flow paths.

14. An ejection head according to claim 12, wherein the liquid flow paths are substantially harmetically separated from each other.

15. An ejection head according to claim 12, wherein different liquids are supplied to the liquid flow paths, respectively.

16. An ejection head according to claim 12, wherein the same liquids are supplied to the liquid flow paths, respectively.

17. An ejection head according to claim 12, further comprising common liquid chambers for containing the liquids to be supplied to the liquid flow paths.

18. An ejection head according to claim 1, wherein the liquid is supplied to the heat generating surface along an inner wall substantially flush with the heat generating surface.

19. An ejection head according to claim 1, wherein an area of the movable member is larger than an area of the heat generating surface.

20. An ejection head according to claim 1, wherein said movable member has a fulcrum portion at a position away from a region of said heat generating surface.

21. An ejection head according to claim 1, wherein the movable member is in the form of a plate.

22. An ejection head according to claim 1, wherein the movable member is of metal.

23. An ejection head according to claim 20, wherein the metal is nickel or gold.

24. An ejection head according to claim 1, wherein the movable member is resin material.

25. An ejection head according to claim 1, wherein the movable member is of ceramic material.

26. An ejection head according to claim 1, wherein the heat generating surface is of an electrothermal transducer for converting electric energy to heat.

27. An ejection head according to claim 1, wherein the heat generated by the heat generating surface causes film boiling of liquid to create the bubble.

28. A liquid ejection head comprising:

a heat generating surface for generating heat for generating a bubble in liquid;

a movable member having a free end and a fulcrum, the free end being disposed downstream of the fulcrum, the movable member and the heat generating surface having a space therebetween;

an ejection outlet for ejecting the liquid using the generation of the bubble, the ejection outlet being opposed to the heat generating surface with said movable member interposed therebetween;

an opposing member cooperable with the movable member to direct the bubble toward the ejection outlet, wherein said opposing member opposes to such a side of the movable member as is near to the heat generating surface when the free end of the movable member is displaced by the bubble; and a fluid flow path through which, as the bubble collapses, the fluid flows downstream and at least partway beneath said movable member into the space, wherein the movable member directs the growing bubble toward the ejection outlet in a direction substantially perpendicular to the heat generating surface.

29. An ejection head according to claim 28, wherein the substrate and the ejection outlet are substantially parallel with each other.

30. An ejection head according to claim 28, wherein the opposing member is a second movable member having a free end, and the free ends of the movable members are opposed to each other with a gap therebetween.

31. An ejection head according to claim 30, wherein a first line perpendicular to the heat generating surface and passing through a center of the heat generating surface, and a second line perpendicular to the gap and passing through a center of the gap, are close to each other.

32. An ejection head according to claim 31, wherein said lines are substantially overlapped with each other.

33. An ejection head according to claim 30, wherein said first line penetrates the ejection outlet.

34. An ejection head according to claim 33, wherein said first line and a line perpendicular to the ejection outlet and passing through a center of the ejection outlet are substantially overlapped with each other.

35. An ejection head according to claim 28, wherein the opposing member is a wall.

36. An ejection head according to claim 35, wherein said first line penetrates the movable member.

37. An ejection head according to claim 35, wherein said first line penetrates the ejection outlet.

38. An ejection head according to claim 37, wherein said first line and a line perpendicular to the ejection outlet and passing through a center of the ejection outlet, are substantially overlapped.

39. An ejection head according to claim 28, wherein liquid flow paths are formed at one side of said movable member and at the other side of said movable member, respectively.

40. An ejection head according to claim 39, wherein the movable member is a part of a separation wall between the liquid flow paths.

41. An ejection head according to claim 39, wherein the liquid flow paths are substantially harmetically separated from each other.

42. An ejection head according to claim 39, wherein different liquids are supplied to the liquid flow paths, respectively.

43. An ejection head according to claim 39, wherein the same liquids are supplied to the liquid flow paths, respectively.

44. An ejection head according to claim 39, wherein the liquid is supplied to the heat generating surface along an inner wall substantially flush with the heat generating surface.

45. An ejection head according to claim 39, wherein an area of the movable member is larger than an area of the heat generating surface.

46. An ejection head according to claim 39, wherein said movable member has a fulcrum portion at a position away from a region of said heat generating surface.

47. An ejection head according to claim 39, wherein the movable member is in the form of a plate.

48. An ejection head according to claim 39, wherein the movable member is of metal.

49. An ejection head according to claim 48, wherein the metal is nickel or gold.

50. An ejection head according to claim 39, wherein the movable member is resin material.

51. An ejection head according to claim 39, wherein the movable member is of ceramic material.

52. An ejection head according to claim 39, further comprising common liquid chambers for containing the liquids to be supplied to the liquid flow paths.

53. An ejection head according to claim 28, wherein the heat generating surface is of an electrothermal transducer for converting electric energy to heat.

54. An ejection head according to claim 39, wherein the heat generated by the heat generating surface causes film boiling of liquid to create the bubble.

* * * * *

UNITED STATES PATENT AND TRADEMARK OFFICE

CERTIFICATE OF CORRECTION

PATENT NO. : 6,007,187

DATED : December 28, 1999

INVENTOR(S) : TOSHIO KASHINO ET AL.

It is certified that error appears in the above-identified patent and that said Letters Patent is hereby corrected as shown below:

COLUMN 1

Line 20, "tion" should read --ting--;
Line 47, "With such" should read --Such--.

COLUMN 2

Line 7, "propose" should read --proposes--;
Line 19, "th" should read --the--;
Line 23, "occurs" should read --occurring--; and
Line 30, "if" should read --.If--.

COLUMN 3

Line 6, "ejection" (first occurrence) should read --ejection efficiency--;
Line 30, "are" should read --is--; and
Line 31, "it is" should read --and it is--.

COLUMN 6

Line 1, "a" (first occurrence) should read --a substrate--; and
Line 56, "squeeze" should read --squeezes--.

UNITED STATES PATENT AND TRADEMARK OFFICE

CERTIFICATE OF CORRECTION

PATENT NO. : 6,007,187

DATED : December 28, 1999

INVENTOR(S) : TOSHIO KASHINO ET AL.

It is certified that error appears in the above-identified patent and that said Letters Patent is hereby corrected as shown below:

COLUMN 8

Line 49, "is an" should be deleted; and
Line 61, "example" should read --an example--.

COLUMN 9

Line 39, "m" should be deleted.

COLUMN 10

Line 12, "example" should read --an example--;
Line 25, "Fig. 2 is a" (second occurrence) should be deleted;
Line 38, "provision" should read --provided--;
Line 52, "An" should read --At--; and
Line 56, "this" should read --there--.

COLUMN 13

Line 26, "function" should read --functions--;
Line 27, "the" (first occurrence) should be deleted; and
Line 50, "provision" should read --provided--.

COLUMN 14

Line 11, "a" should read --are--; and
Line 21, "growths" should read --grows--.

UNITED STATES PATENT AND TRADEMARK OFFICE

CERTIFICATE OF CORRECTION

PATENT NO. : 6,007,187

DATED : December 28, 1999

INVENTOR(S) : TOSHIO KASHINO ET AL.

It is certified that error appears in the above-identified patent and that said Letters Patent is hereby corrected as shown below:

COLUMN 15

Line 1, "may" should read --may be--;
Line 28, "generate" should read --generates--; and
Line 65, "desirable" should read --desirable that--.

COLUMN 16

Line 12, "pressure" should read --pressurized--; and
Line 20, " side side" should read --side--.

COLUMN 17

Line 2, "conventional" should read --conventional head--;
Line 17, "ponent" should read --ponents--; and
Line 22, "growths" should read --grows--.

COLUMN 18

Line 44, "in" should read --on--; and
Line 65, "is an" should be deleted.

COLUMN 19

Line 2, "in" should read --on--.

UNITED STATES PATENT AND TRADEMARK OFFICE

CERTIFICATE OF CORRECTION

PATENT NO. : 6,007,187

DATED : December 28, 1999

INVENTOR(S) : TOSHIO KASHINO ET AL.

It is certified that error appears in the above-identified patent and that said Letters Patent is hereby corrected as shown below:

COLUMN 20

Line 26, "1" should read --head--;
Line 27, "is" (first occurrence) should be deleted; and
Line 34, "a" should be deleted.

COLUMN 21

Line 32, "is a" should read --are-- and "view" should read --views--; and
Line 36, "show" should read --FIG. 21C--.

COLUMN 23

Line 2, "of" should read --is of--; and
Line 22, "eve" should read --even--.

COLUMN 26

Line 27, "Next," should read --¶ Next,--.

COLUMN 27

Line 6, "a pproximately" should read --approximately--.

COLUMN 28

Line 50, "placed" should read --plated--.

UNITED STATES PATENT AND TRADEMARK OFFICE

CERTIFICATE OF CORRECTION

PATENT NO. : 6,007,187

DATED : December 28, 1999

INVENTOR(S) : TOSHIO KASHINO ET AL.

It is certified that error appears in the above-indentified patent and that said Letters Patent is hereby corrected as shown below:

COLUMN 30

Line 14, "provide" should read --provided--; and
Line 25, "preciding" should read --preceding--.

COLUMN 34

Line 63, "harmetically" should read --hermetically--.

COLUMN 35

Line 21, "claim 20," should read --claim 22,--.

COLUMN 36

Line 28, "harmetically" should read --hermetically--.

Signed and Sealed this

Third Day of April, 2001

*Attest:*

Nicholas P. Godici

NICHOLAS P. GODICI

*Attesting Officer*

*Acting Director of the United States Patent and Trademark Office*